US007082912B2

(12) United States Patent
Folino

(10) Patent No.: US 7,082,912 B2
(45) Date of Patent: Aug. 1, 2006

(54) SYSTEM AND METHOD FOR CONTROLLING ENGINE VALVE LIFT AND VALVE OPENING PERCENTAGE

(76) Inventor: Frank A. Folino, 17 Indian Hill La., Salem, MA (US) 13827

( * ) Notice: Subject to any disclaimer, the term of this patent is extended or adjusted under 35 U.S.C. 154(b) by 0 days.

(21) Appl. No.: 11/187,759

(22) Filed: Jul. 22, 2005

(65) Prior Publication Data

US 2006/0000436 A1 Jan. 5, 2006

Related U.S. Application Data

(63) Continuation-in-part of application No. 10/663,965, filed on Sep. 16, 2003, now Pat. No. 6,953,014, which is a continuation-in-part of application No. 10/099,117, filed on Mar. 15, 2002, now Pat. No. 6,619,250.

(60) Provisional application No. 60/590,527, filed on Jul. 23, 2004, provisional application No. 60/276,889, filed on Mar. 16, 2001.

(51) Int. Cl.
*F01L 1/34* (2006.01)

(52) U.S. Cl. ..... 123/90.16; 123/90.26; 123/90.6

(58) Field of Classification Search ..... 123/90.15, 123/90.16, 90.17, 90.2, 90.24, 90.25, 90.26, 123/90.6; 74/567, 569, 559
See application file for complete search history.

(56) References Cited

U.S. PATENT DOCUMENTS

| | | | | |
|---|---|---|---|---|
| 577,589 | A | 2/1897 | Teubert | |
| 1,309,339 | A | 7/1919 | Reynolds | |
| 1,561,544 | A | 11/1925 | How | |
| 1,679,794 | A | 8/1928 | Smith | |
| 2,466,550 | A | 4/1949 | Lundquist | |
| 2,584,055 | A | 1/1952 | Smith | |
| 2,641,236 | A | 6/1953 | Mansfield | |
| 2,738,748 | A | 3/1956 | Hecht | |
| 2,823,655 | A | 2/1958 | Repko | |
| 2,954,017 | A | 9/1960 | Forstner | |
| 3,020,018 | A | 2/1962 | Stram | |
| 3,195,528 | A | 7/1965 | Franklin | |
| 3,317,179 | A | 5/1967 | Willis | |
| 3,424,024 | A | 1/1969 | Derbfuss | |
| 3,585,974 | A | 6/1971 | Weber | 123/90.12 |
| 3,641,988 | A | 2/1972 | Torazza et al. | 123/90.16 |
| 3,684,237 | A | 8/1972 | Hyde et al. | 251/58 |
| 3,911,879 | A | 10/1975 | Altmann | 123/90.16 |
| 3,952,995 | A | 4/1976 | Nagumo et al. | 251/232 |

(Continued)

FOREIGN PATENT DOCUMENTS

DE 1 105 659 4/1961

(Continued)

OTHER PUBLICATIONS

"What does desmo mean?", Desmodromic Valve Gear; http://www.usq.edu.au/users/grantd/mcycle/desmo.htm; Nov. 23, 2001.

(Continued)

*Primary Examiner*—Thomas Denion
*Assistant Examiner*—Ching Chang
(74) *Attorney, Agent, or Firm*—Burns & Levinson LLP; Jacob N. Erlich; Peter J. Borghetti

(57) ABSTRACT

System and method for controlling internal combustion engine valve lift and valve opening by an arrangement of cams with overlapping cams track that synchronize and vary the rise, fall, and dwell of the inlet and exhaust valves of an IC engine.

6 Claims, 19 Drawing Sheets

U.S. PATENT DOCUMENTS

| | | | | |
|---|---|---|---|---|
| 4,061,115 | A | 12/1977 | Predhome, Jr. | 123/90.16 |
| 4,158,367 | A | 6/1979 | Mailliet | 137/340 |
| RE30,188 | E | 1/1980 | Predhome, Jr. | 123/90.16 |
| 4,190,074 | A | 2/1980 | Mailliet et al. | 137/315 |
| 4,457,268 | A | 7/1984 | Jones | 123/90.23 |
| 4,514,129 | A | 4/1985 | Legille et al. | 414/200 |
| 4,570,900 | A | 2/1986 | Lonardi et al. | 251/58 |
| 4,671,221 | A | 6/1987 | Geringer et al. | 123/90.16 |
| 4,674,451 | A | 6/1987 | Rembold et al. | 123/90.16 |
| 4,763,615 | A | 8/1988 | Frost | 123/90.25 |
| 4,805,568 | A * | 2/1989 | Springer et al. | 123/188.9 |
| 4,858,573 | A | 8/1989 | Bothwell | 123/90.15 |
| 4,887,564 | A | 12/1989 | Edwards | 123/90.25 |
| 4,898,130 | A | 2/1990 | Parsons | 123/90.16 |
| 5,016,581 | A * | 5/1991 | Parsons | 123/90.25 |
| 5,127,375 | A | 7/1992 | Bowman et al. | 123/90.12 |
| 5,732,670 | A | 3/1998 | Mote, Sr. | 123/90.24 |
| 5,782,216 | A | 7/1998 | Haas et al. | 123/90.16 |
| 5,809,951 | A | 9/1998 | Kim | 123/90.16 |
| 6,000,375 | A | 12/1999 | Isobe | 123/322 |
| 6,311,659 | B1 | 11/2001 | Pierik | 123/90.24 |
| 6,619,250 | B1 | 9/2003 | Folino | 123/90.16 |

FOREIGN PATENT DOCUMENTS

| | | | |
|---|---|---|---|
| DE | 3804333 | A1 | 8/1989 |
| DE | 3841839 | A | 6/1990 |
| EP | 91804 | A1 | 10/1983 |
| EP | 0 311 282 | | 4/1989 |
| FR | 2467971 | A | 5/1981 |
| GB | 939 895 | | 10/1963 |
| JP | 03168307 | A | 7/1991 |
| WO | WO 98/36157 | | 8/1998 |

OTHER PUBLICATIONS

Supplementary European Search Report mailed Dec. 1, 2004, European Patent Application No. EP02723470, European Patent Office, p. 2, Documents Considered to be Relevant, Relevant to Claim column (please note that DE3804333 was submitted in an Information Disclosure Statement mailed Feb. 13, 2004).

* cited by examiner

SYSTEM AND METHOD FOR CONTROLLING ENGINE VALVE LIFT AND VALVE OPENING PERCENTAGE

CROSS REFERENCE TO RELATED APPLICATIONS

The present application is a continuation-in-part application of U.S. patent application Ser. No. 10/663,965, filed Sep. 16, 2003 and entitled "THERMAL COMPENSATING DESMODROMIC VALVE ACTUATION SYSTEM" (now U.S. Pat. No. 6,953,014), which is a continuation-in-part application of U.S. patent application Ser. No. 10/099,117, filed Mar. 15, 2002 and entitled "DESMODROMIC VALVE ACTUATION SYSTEM" (now U.S. Pat. No. 6,619,250), which claims benefit of U.S. Provisional Application Ser. No. 60/276,889, entitled "VARIABLE VALVE SYSTEM" filed on Mar. 16, 2001, and the present application also claims benefit of U.S. Provisional Application Ser. No. 60/590,527, entitled "VARIABLE VALVE SYSTEM" filed on Jul. 23, 2004. The above-identified applications are incorporated herein by reference.

FIELD OF THE INVENTION

The present invention relates generally to a system and method for controlling internal combustion (IC) engine valve lift and valve opening percentage, and, more particularly, to an arrangement of cams with overlapping cam tracks that synchronize and vary the rise, fall, and dwell of the inlet and exhaust valves of an IC engine.

BACKGROUND OF THE INVENTION

The pursuit of optimal performance of spark ignition internal combustion (IC) engines typically found in present-day automobiles has been profoundly intensified to increase performance and efficiency while decreasing undesirable exhaust emissions. The original equipment manufacturers (OEM) in the automotive industry are critically invested in the IC engine and have developed an infrastructure of resources and research activities that are not easily replaceable. Also, the performance and drivability of these automobiles are well indoctrinated and accepted by consumers worldwide. Finally, the economy throughout the industrialized world is largely dependent on fossil fuel for powering not only passenger vehicles but also commercial vehicles for trade and travel.

Accordingly, OEMs have, especially in the last twenty years, diligently pursued research activities to develop systems and processes to improve vehicle performance in both torque and efficiency, and to ameliorate the ecological impact of emissions. Advances in performance include turbo and superchargers, fuel direct injection systems, multi-valve intake and exhaust porting for each cylinder, computer control management of the combustion cycle, advanced transmission and catalytic converters for removing undesirable emissions from the exhaust gasses. These efforts have introduced automobiles on the highways with much improved performance, greater fuel efficiencies, electronics control systems that monitor and adjust the critical parameters of the vehicle in real-time and cleaner exhaust emissions that are becoming more acceptable to the environment.

Nevertheless, despite these advances to date, there are increasing burdens on OEMs to further improve vehicular performance, increase fuel efficiency and reduce emissions. Ecological limitations dictate a substantially reduced level of emissions that must be achieved in the immediate future and the cost of fuel has become a significant factor in the overall operating expense of the vehicle. The OEMs must rely on their resources and expertise yet again to meet these demanding challenges. The IC engine is at the center of these challenges and accordingly is receiving top priority by all OEMs.

A major effort is focused on the upgrading of IC engine performance through the improvement of the quality of air/fuel mixture, pre-ignition mitigation via producing a homogeneous and well-dispersed mixture within the cylinder and the advanced control of both valve timing and percentage of valve port opening. These new qualities have been the basis of ever expanding combustion design strategies. There are dogmas in the combustion process which, when adhered to, can produce a performance substantially higher and with less emission than today's vehicles.

In terms of torque and efficiency, the optimization of volumetric efficiency at all engine speeds maximizes the torque delivered; timing of the porting of the inlet valve enhances the homogeneity of the air/fuel mixture for more complete combustion for optimal power, and a cleaner more complete burn producing lower levels of emissions. The ultimate goal is to achieve a stoichiometric charge that theoretically provides maximum efficiency and emission containing harmful by-products. These and other strategies are being investigated with the expectations that new systems will evolve that can contribute to more efficient performance with minimized levels of emissions.

It is well documented and established that infinitely variable valve actuation provides the ultimate opportunity to maximize engine performance and lower emissions. Valving control at all engine speeds and with a stoichiometric charge on demand is a formidable challenge and has the imprimatur of a select high performance group of vehicles that have achieved some success in their operation. The conventional vehicle on the road today offers a fixed cam configuration providing the same valve timing and valve lift at all engine speeds. For this condition there is no opportunity to vary the port opening to capture the full charge of air to maximize torque at all engine speeds, particularly in the mid to high range. To insure maximum power at these levels, valve lift is designed for high-end engine speeds. As a result, performance through the speed range is compromised delivering less efficient performance at all other engine speeds. Among the combustion strategies that are aligned to maximize the combustion process and address the above issues is a technology that involves infinitely variable valve actuation, which under computer control can vary the timing and valve lift.

It is, therefore, an object of the present invention to provide means that will significantly improve the performance of an IC engine as typically found in an automobile by means that provides essentially infinite control of the valve timing in opening and closing of valves in concert with valve percentage port opening for all engine speeds.

It is another object to provide precise lead and lag angles of the intake and exhaust valves in real time.

It is yet another object that computer control of the means will provide command and control that essentially provides infinite control.

It is also a further object to provide delivery of performance efficiently and effectively over the full spectrum that is repeatable and smooth to enhance the driveability of the vehicle.

It is a further object to provide attributes for a system that is infinitely variable in function and in real time that is simple, robust and economical for the complex functions of varying phase angles and percent of valve opening of valves in concert with the vehicle performance.

It is a further object to provide a total system capable of delivering engine performance throughout a speed spectrum that will substantially exceed those available in present-day vehicles without sacrificing power.

It is also a further object to provide the control and means of producing cylinder de-activization such that a six-cylinder engine can function on two, four or six cylinders.

It is yet a further object to provide enhanced engine performance by providing near stoichiometric charges at all engine speeds providing the ultimate opportunity to near zero emissions.

SUMMARY OF THE INVENTION

These and other objects are well met by the infinitely variable valve timing and lifting systems of the present invention for uses with, for example, an internal combustion engine. In one aspect of the present invention presents an apparatus for essentially infinitely varying the valve lift. A cam configuration promotes phase angle control while, at the same time, providing the linear reciprocating motion to operate the valve opening and closing. The cam includes a fixed cam groove configuration that does not allow for any articulation to index the cam for changing the phase angle. It merely provides a reciprocating motion to exercise the valve and vary the lift. The cam configuration of the present invention not only incorporates the reciprocating motion for varying valve lift, but with a unique camshaft design and mechanical control module the cam is capable of articulating not only lead and lag phase angles for valve timing. The cam can also be designed to change the profile of the intake and exhaust motion characteristics.

In another aspect of the present invention, a unique camshaft design having, for example, four concentric shafts simultaneously rotating at the same speed and each shaft individually controlled by an indexing mechanism, such as the indexing mechanism described in U.S. Pat. No. 4,305,352, by Oshima et al. ("Oshima"), which is incorporated herein by reference. Concentric shafts are defined as two or more shafts that have a common centerline and where small outer diameter shafts are assembled within larger inner diameter shafts. However, the indexing mechanism is not to be limited to any one embodiment. For illustration purposes only components and features disclosed in Oshima will be described in detail. Motion from the crankshaft is delivered to a mechanical control module wherein four such mechanisms, as described in Oshima, will rotate the four concentric shafts at the same speed. Upon command from the electronic computer module the mechanisms will index the desired concentric shaft to the desired phase angle. Each of the concentric shafts will articulate one cam containing any of four configurations; intake rise, intake fall, exhaust rise, exhaust fall. If the command, for example, is to change the intake valve phase angle to a new lead phase angle, the command or signal will be transmitted by a computerized electronic control unit (ECU) to the mechanical control unit (MCU) to index the intake rise cam mechanism to the appropriate lead angle. In like manner, if at the same time the command was given to change the phase angle of the fall cycle to a lag phase angle, the command can be transmitted by the ECU to the mechanical control unit to index the fall cycle cam accordingly by the mechanism that controls the concentric shaft of the fall cycle cam. Upon command from the ECU to the MCU, the four concentric shafts all rotating synchronously and in concert with the crankshaft can be independently indexed to articulate the cam lead and lag angles thereby controlling the opening and closing of the valves. With appropriate data gathering and programming into the ECU, the articulated cams can be commanded by the ECU to provide the appropriate timing for opening and closing of valves to achieve the performance in accordance with the operating speed of the IC engine.

It is significantly advantageous to be able to adjust the opening and closing phase angles of the intake and exhaust valves of an IC engine and accordingly change their timing in accordance with engine speed. By effective selection of these phase angles, it is possible to adjust the overlap of intake valves opening and exhaust valve closing as a function of engine speed and enhance engine performance. There has been a long felt need in the industry to achieve an effective, efficient and economical variable timing system. The present invention is a variable lift system with integrated variable timing mechanism that is effectively integrated into the variable lift mechanism and has produced a total system of infinitely variable valve timing and lift that is simple, robust and economical.

For a better understanding of the present invention, together with other and further objects thereof, reference is made to the accompanying drawings and detailed description.

BRIEF DESCRIPTION OF THE DRAWINGS

The present invention is illustratively shown and described in reference to the accompanying drawings, in which.

DETAILED DESCRIPTION OF THE INVENTION

Figures 1A, 1B, 1C:
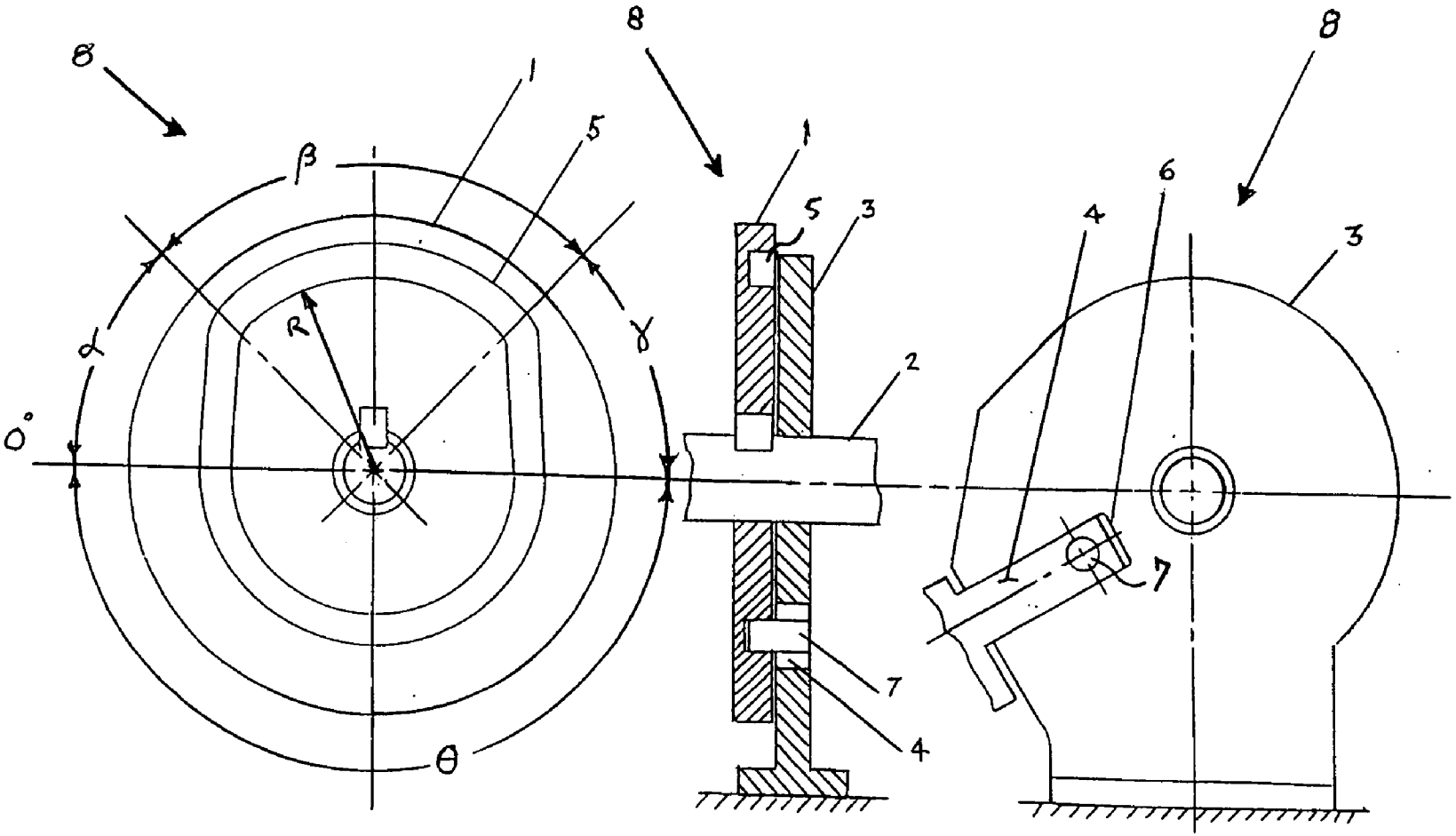
FIG. 1A is a pictorial view of one embodiment of the desmodromic valve actuator of the present invention illustrating a single rotating disc and a single stator housing.
FIG. 1B is a pictorial view of the single rotating disc of FIG. 1A illustrating an exemplary cam embodiment.
FIG. 1C is a pictorial view of the single stator housing of FIG. 1A illustrating an exemplary slide and slot embodiment.

Shown in FIGS. 1A, 1B, 1C is a variable mechanism 8 that infinitely varies the valve lift to throttle the amount of air entering each cylinder of an engine as a function of engine speed. As shown, variable mechanism 8 illustrates only the motivating action of the system that has a mechanism that provides the variable valve lift (discussed in detail below).

Variable mechanism 8 illustrates rotating disc 1 keyed (FIG. 1B) to camshaft 2 and rotates relative to fixed stator housing 3 (FIG. 1C) in which slide 4 reciprocates in slot 6. Slide 4 reciprocation is affected by fixed cam 5 (FIGS. 1A, 1B) in rotating disc 1 and is reacted by cam follower 7 of slide 4. For example, at 0° start (FIG. 1A) follower 7 advances, indexes, or rotates through angle $\alpha$ and displaces slide 4 in slot 6 to its maximum out position. At this time, if the variable mechanism 8 is controlled to achieve maximum valve lift, the valve will be opened at its maximum opened condition through the cam angle $\beta$ at a constant radius R. The cam angle $\alpha$ will displace slide 4 inwardly to its original position, which will close the valve. As disc 1 rotates through angle $\phi$, the valve remains closed and when it reaches 0° after one complete rotation it is ready to repeat the motion. Fixed cam 5 functions solely as a motivating reciprocating motion and, controls opening and closing of the valve at the same angles for every rotation of camshaft 2.

Figures 2A, 2B, 2C:
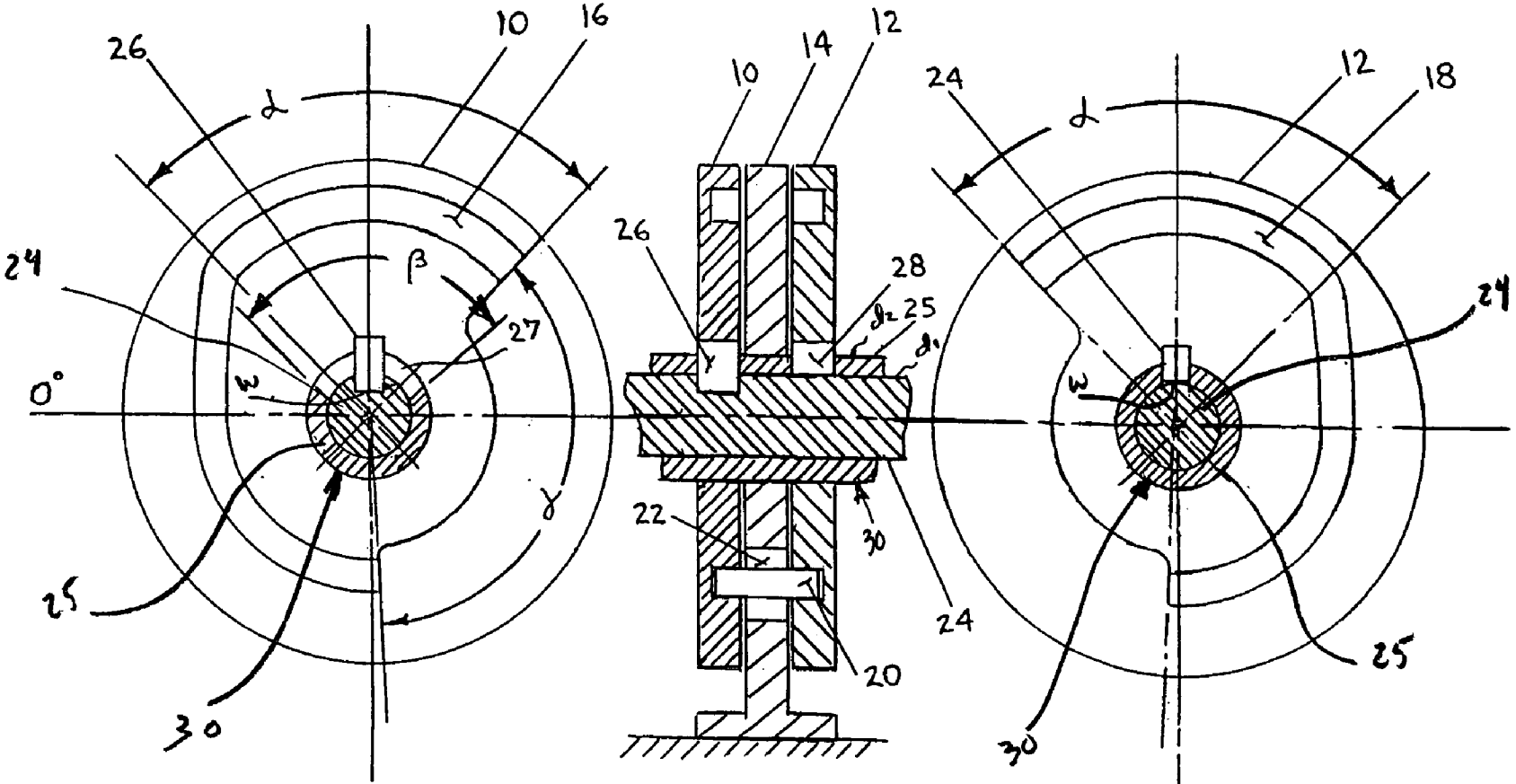
FIG. 2A is a pictorial view of another embodiment of the desmodromic valve actuator of the present invention illustrating two rotating discs and a single stator housing.
FIGS. 2B–C are pictorial views of the two rotating discs of FIG. 2A illustrating exemplary cam embodiments.
Figure 2D:
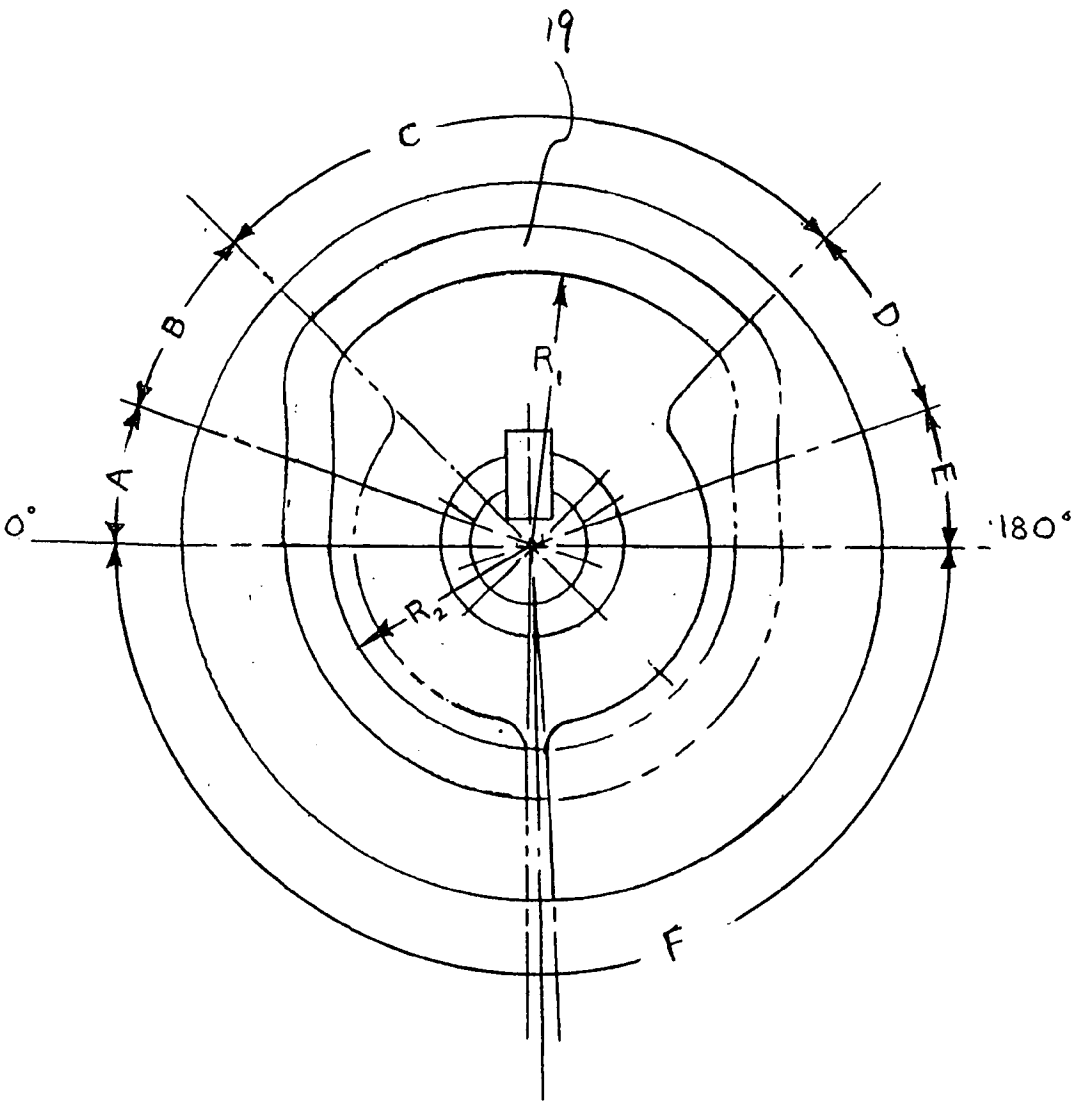
FIG. 2D is a pictorial view of a contiguous cam formed by the two overlapping discs, shown solid and phantom, of FIGS. 2B–C.

FIG. 2A illustrates an assembly of two disc cams 10, 12 and stator housing 14. FIGS. 2B and 2C are pictorials of cam discs 10, 12, respectively, with discontinuous cam tracks 16, 18, respectively. These cam tracks when assembled have an overlay pattern as shown in FIG. 2D. When disc cams 10, 12 are positioned at 0°, cam tracks 16, 18 present a continuous 360° cam track 19. Follower 20 (FIG. 2A) will react to either one of the two cam tracks 16, 18 or both cam tracks 16, 18 in synchronous with each other to displace slide 22 to motivate the opening and closing of the valves discussed in detail below. Disc cams 10, 12 are mounted on the outside diameters d1, d2 (FIG. 2A) of the concentric shafts 24, 25, respectively, upon which disc cam 10 is rotated and indexed by inner shaft 24 and key 26, and disc cam 12 is rotated and indexed by outer shaft 25 and key 28. Concentric shafts 24, 25 are combined as camshaft 30 and are controlled to rotate synchronously at the same speed except when indexed to a new opening or closing phase angle. As shown in FIG. 2A, contiguous cam track 30 offered by overlapping disc cams 10, 12, shown solid and phantom (respectively), will open the valve at 0° and close it at 180°. The cam profile of continuous cam track 30 illustrates, but not limited to, one of many profiles, and consists of ramp angle A, a small rise for initial acceleration; angle B for accelerating to maximum opening at radius R2; and angle C is a dwell period during which the valve remains fully opened at 90°, as shown; angle D starts the deceleration and closing; angle E completes the closing and its very small ramp angle is designed to minimize noise of the valve closing at R1. At 180°, the cam has closed the valve at radius R1 and will keep it closed through the angle F at which time a new cycle will start. The present invention of variable timing has markedly impacted the variable lift mechanism design without altering its characteristics of varying the percentage of valve opening.

Figure 3B:
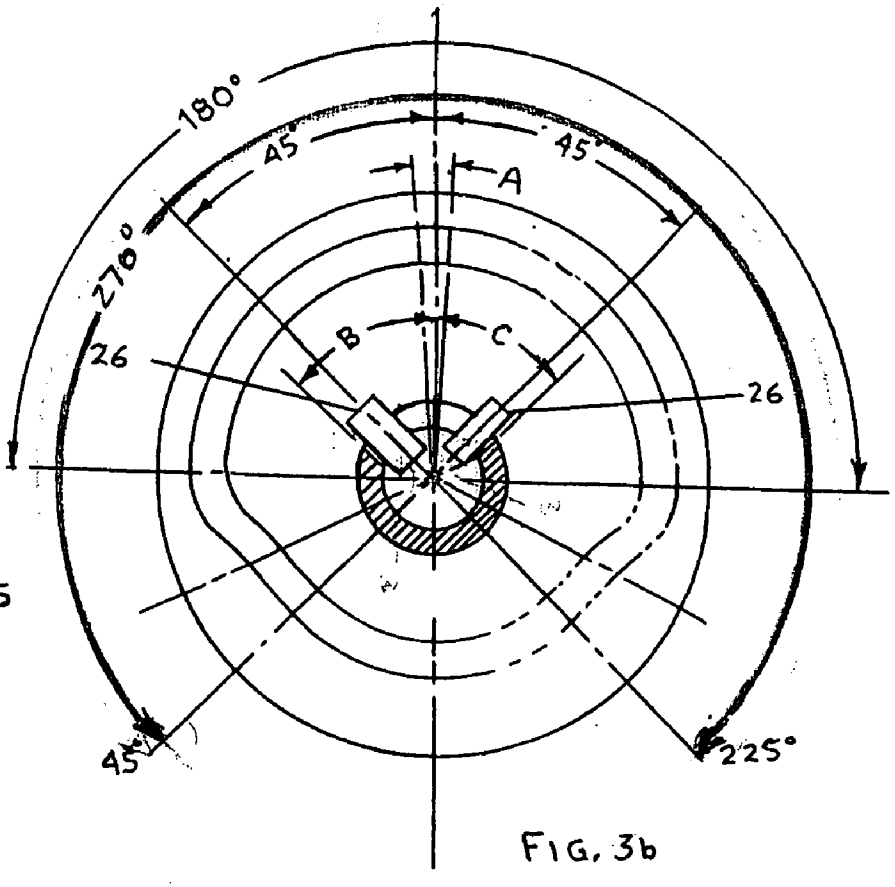
FIG. 3B is a pictorial view of the contiguous cam of FIG. 2D illustrating a maximum lead angle of 45° to −45° position and maximum lag angle of 45° to 225° position.
Figure 3A:
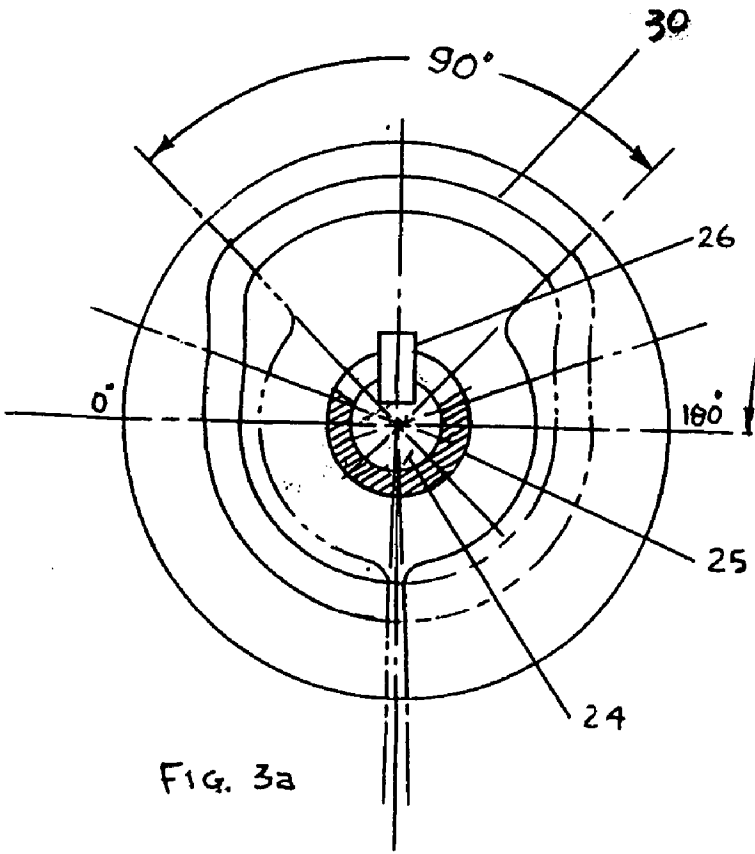
FIG. 3A is a pictorial view of the contiguous cam of FIG. 2D having a dwell angle of 90° for full valve opening and illustrating the valve opened at 0° and closed at 180°.

As illustrated in FIGS. 3A, there is no discontinuity in continuous cam track 30 with cam tracks 16, 18 overlaid as earlier described at 0° position of no lead or lag phase angle. In this condition, the dwell angle of 90° for full valve opening is shown as the valve will open at 0° and close at 180°. FIG. 3B illustrates another possible profile of a continuous cam track having maximum lead angle of 45° to −45° position and maximum lag angle of 45° to 225° position. This capability is available for both the intake and exhaust valves, such that with a 45° lead phase angle of the intake valve to −45° position and a lag phase angle of 45° to 225° position the maximum valve open condition of 270° is possible. Accordingly, for a lead phase angle of 45° for the intake valve and a lag phase angle of 45° a maximum overlap of the intake and exhaust valves of 90° is possible. This may be very desirable in very high speed engines of racing cars but intermediate variable valve overlap for engine speed spectrums of present day automobiles is easily accommodated by the present invention.

Now returning to FIG. 2*a*, disc cam 10 is driven by key 26 both for rotation of the engine speed and indexing by the MCU (discussed in detail below). Indexing for disc cam 10 is accomplished by rotating disc cam 10 by key 26 in inner shaft 24 by speeding up or slowing down inner shaft 24 relative to outer shaft 25. In the process key 26 requires a clearance slot 27 in outer shaft 25 for the indexing angles, for example, of 45°. These clearance angles are shown in FIG. 3B as angle B and C such that slot angle in shaft 25 is B and C and the clearance slot width (w) must be greater than the width of key 26. Angle A (FIG. 3B) is the amount of overlay of the two discontinuous cam tracks 16, 18 at the maximum valve overlap of 270°.

Figures 4A, 4B, 4C:
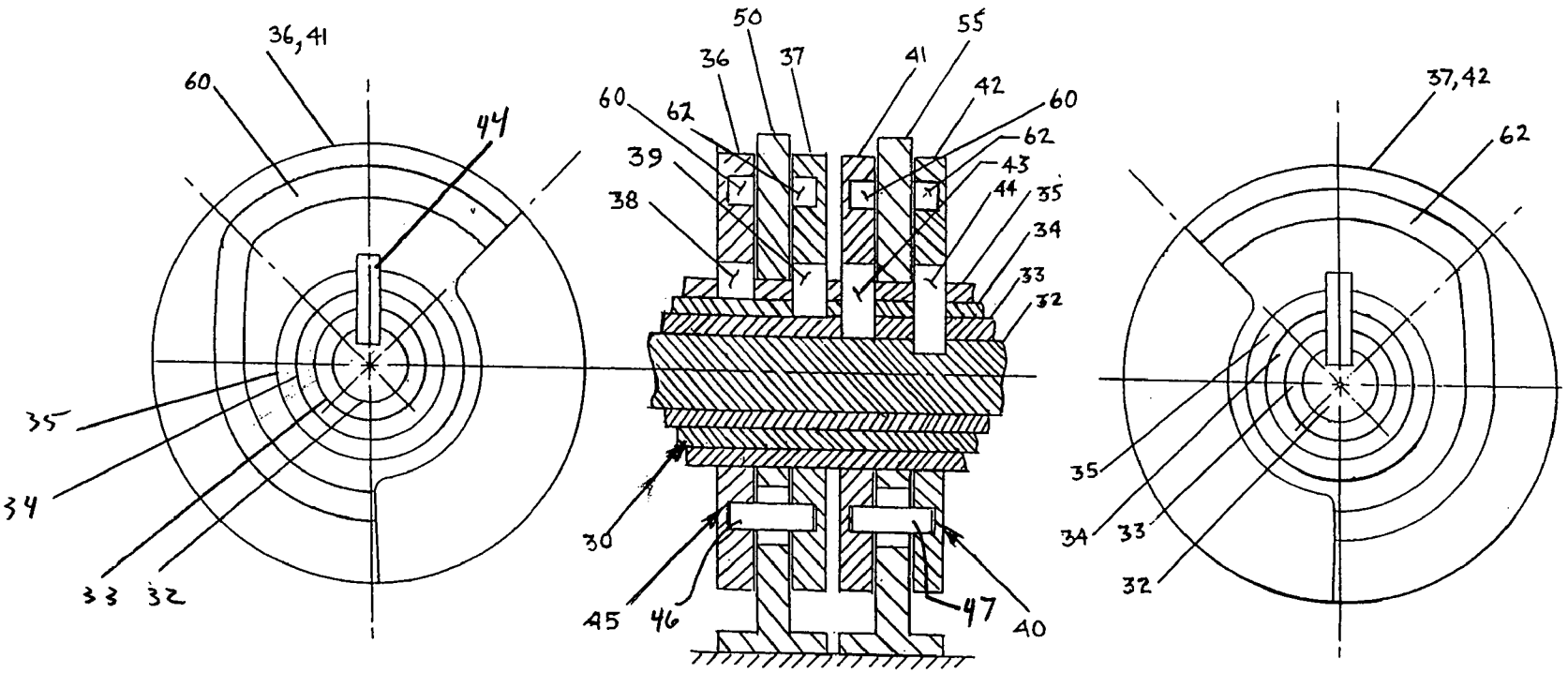
FIGS. 4A–E are pictorial views of an exemplary embodiment of a four-concentric shafts camshaft of the present invention illustrating use of two desmodromic valve actuators of FIG. 2A as an intake valve assembly and an exhaust valve assembly.
Figures 5A, 5B, 5C, 5D:
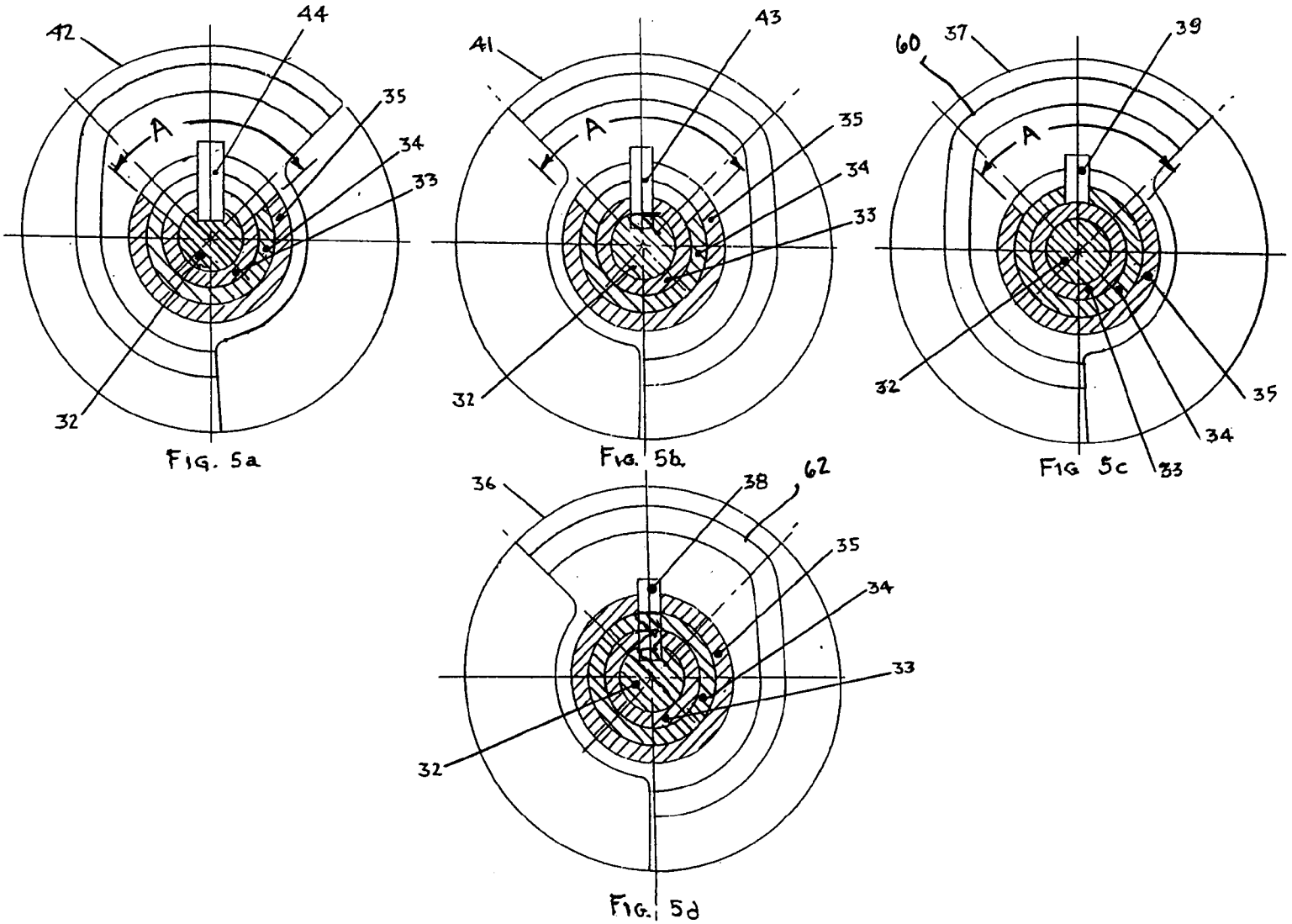
FIGS. 5A–D are pictorial views of the present invention of FIG. 4A illustrating various cam slot configurations relative to the keying of the four-concentric shafts.

FIGS. 4A, 4B and 4C illustrate a camshaft assemblage 30 of a four-concentric shafts 32, 33, 34, 35 with an intake valve assembly 40 and exhaust valve assembly 45. The discs 36, 37, 41, 42 are driven by their respective shafts;

disc 36 by shaft 35 and key 38 (FIG. 5A);

disc 37 by shaft 34 and key 39 (FIG. 5B);

disc 41 by shaft 33 and key 43 (FIG. 5C);

disc 42 by shaft 32 and key 44 (FIG. 5D).

Figure 4E:
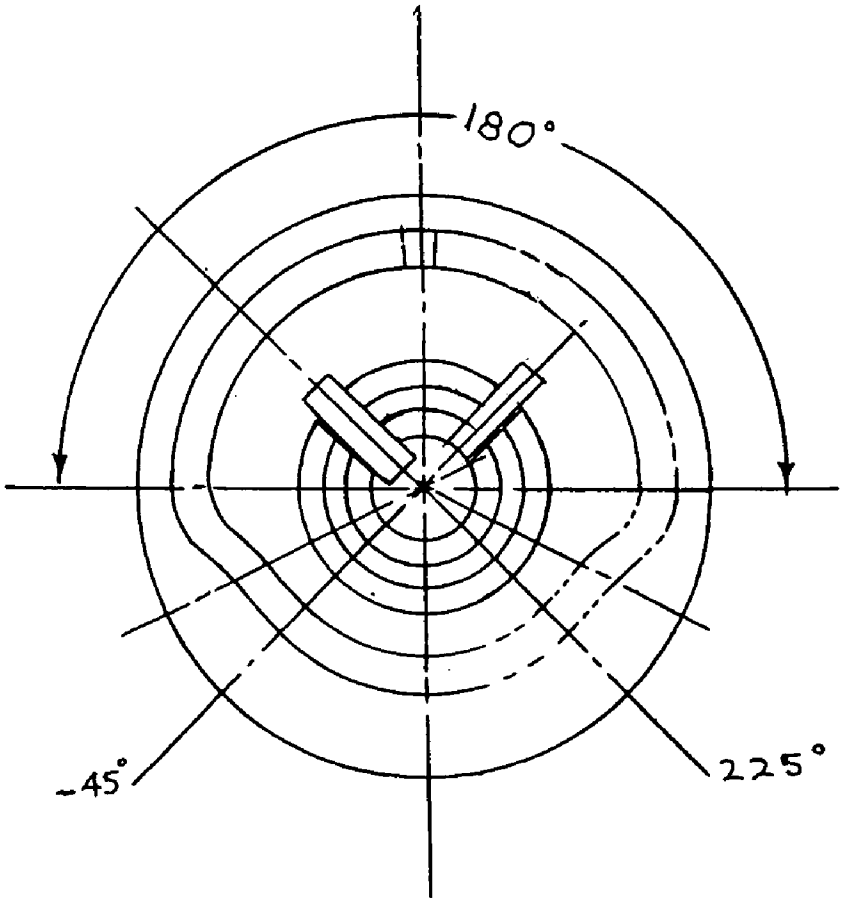
Figure 4D:
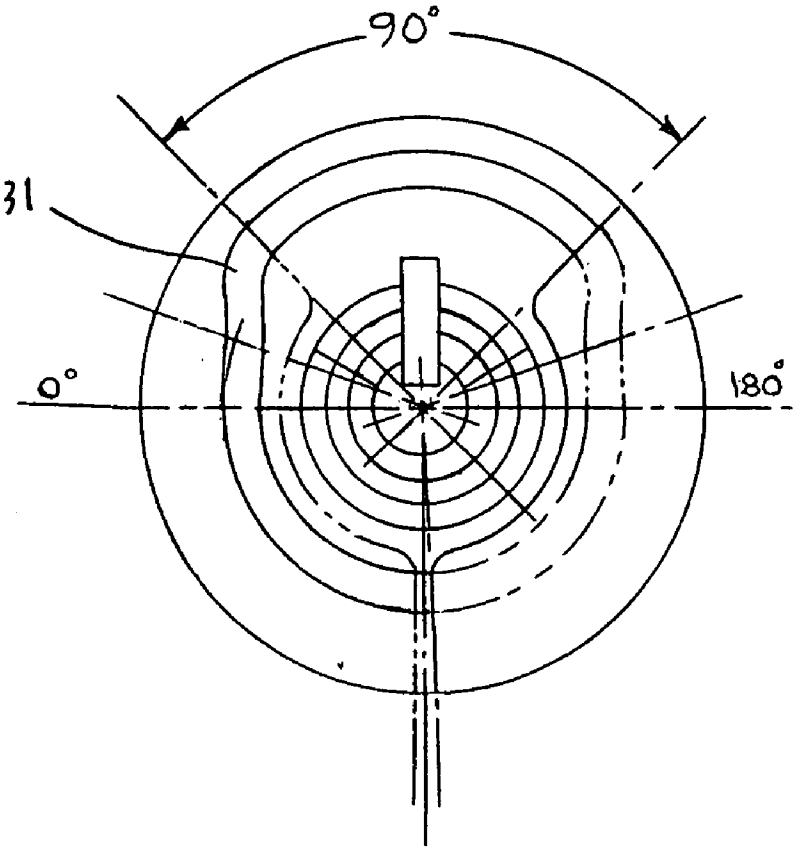

Shown in FIG. 4B are stator housings 50 and 55, one for each valve. The discontinuous cam tracks 60, 62 in the discs 36, 41 and 37, 42, respectively, form continuous cam track 31 (FIG. 4D) for each valve and shown for minimum and maximum phase angles.

FIG. 5A illustrates shaft 32 with key 44 driving disc 42, one intake disc. Angle A in FIG. 5A defines widths of slots 33A, 34A, 35A machined in shafts 33, 34, 35 whose width is slightly larger than key 44. Slots 33A, 34A, 35A will provide the clearance for the swept volume of the key 44 as it indexes the disc 42 to the commanded phase angle, A.

In like manner, disc 41 (FIG. 5B) is driven by shaft 33 through key 43 and is the compliment to disc 42 to provide a continuous cam groove 31 (FIG. 4D) for follower 47 of intake valve assembly 40.

Exhaust valve discs 36, 37 are shown in FIGS. 5D and 5C, respectively. As shown in FIG. 5C, shaft 34 through key 39 drives disc 37, one of the exhaust discs. Slot 35A for clearance angle A is only required in shaft 35. As shown in FIG. 5D, complimentary disc 36 is driven by shaft 35 through key 38. Since this is the outside shaft, there are no shafts through which key 38 must rotate. Discs 36 and 37 are complimentary to each other and their cam grooves 60 and 62, respectively, provide a continuous cam track for follower 47 of the exhaust valve actuating intake valve assembly 40.

Figure 6B:
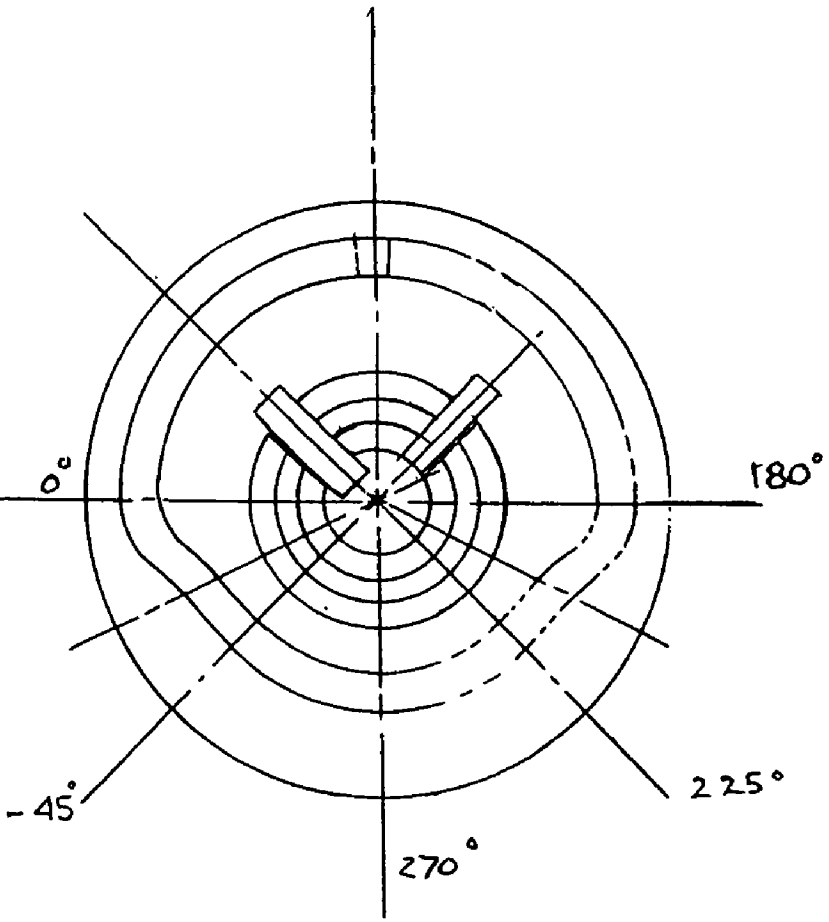
FIGS. 6A–B are pictorial views of one valve of the single four-concentric shaft camshaft of FIG. 4A illustrating a minimum 0° to 180° valve opening angle and maximum −45° to 225°, 270° valve opening angle.
Figure 6A:
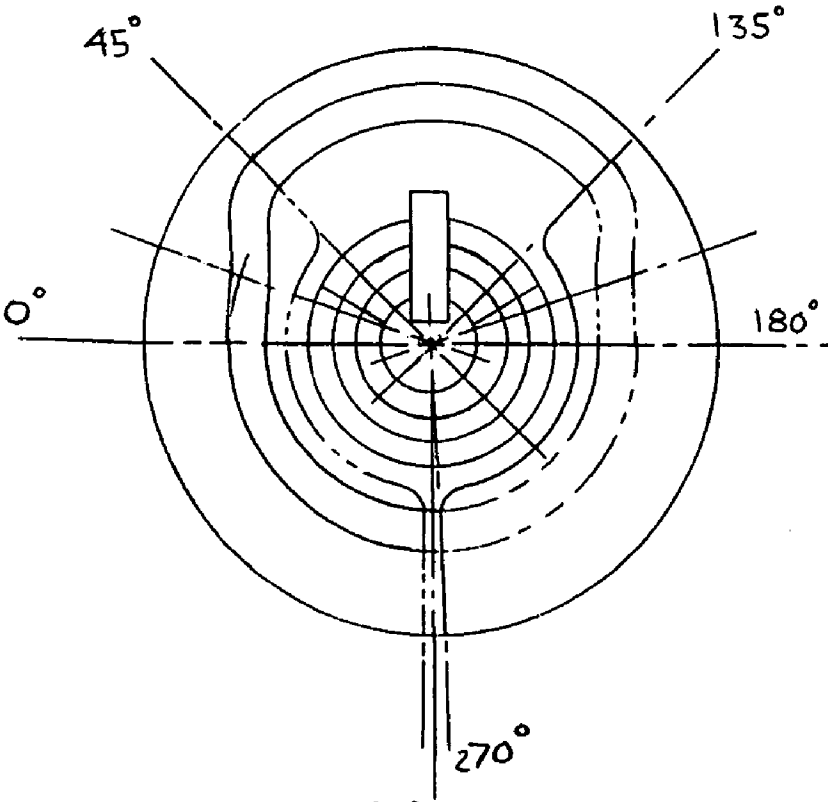

FIGS. 6A and 6B illustrate the single four-concentric shaft camshaft 30 of one valve featuring the minimum 0° to 180° and maximum −45° to 225°, 270° valve opening angle. The illustration is only by way of describing the technology and does not infer any explicit design as the number of combustion strategies are many and any of which can be accommodated by the infinitely variable timing mechanism.

The controls of one embodiment of the present invention index the cams for varying the lead or lag phase angle and affecting valve timing includes planetary gearing in the valve drive train at the appropriate ratio to: (1) drive the camshaft at the required speed and, (2) to index the cams to any desired lead or lag phase angle. The present invention overcomes the shortcomings of the prior art to provide flexibility to optimize engine performance with engine speed. The prior art teaches fixed cams on the camshaft that are only able to affect the overlap region of the intake and exhaust timing, and provides no air throttling, cam profiling or individual cylinder performance. The planetary gearing system of the present invention is an integral part of a total infinitely variable timing and valve lift system that offers latitude to optimize combustion strategy in terms of power and emissions as well as efficiency. Matching engine speed with air/fluid mixture to optimize performance and minimize emissions on command. Stochiometric combustion is essentially achievable at all engine speeds as well as de-activization of cylinders such that a six or eight cylinder engine can be a 2-4-6 or 4-6-8 cylinder engine. Of course, this capability is available to any number of cylinders as the six and eight examples were for description purposes only.

Figure 7:
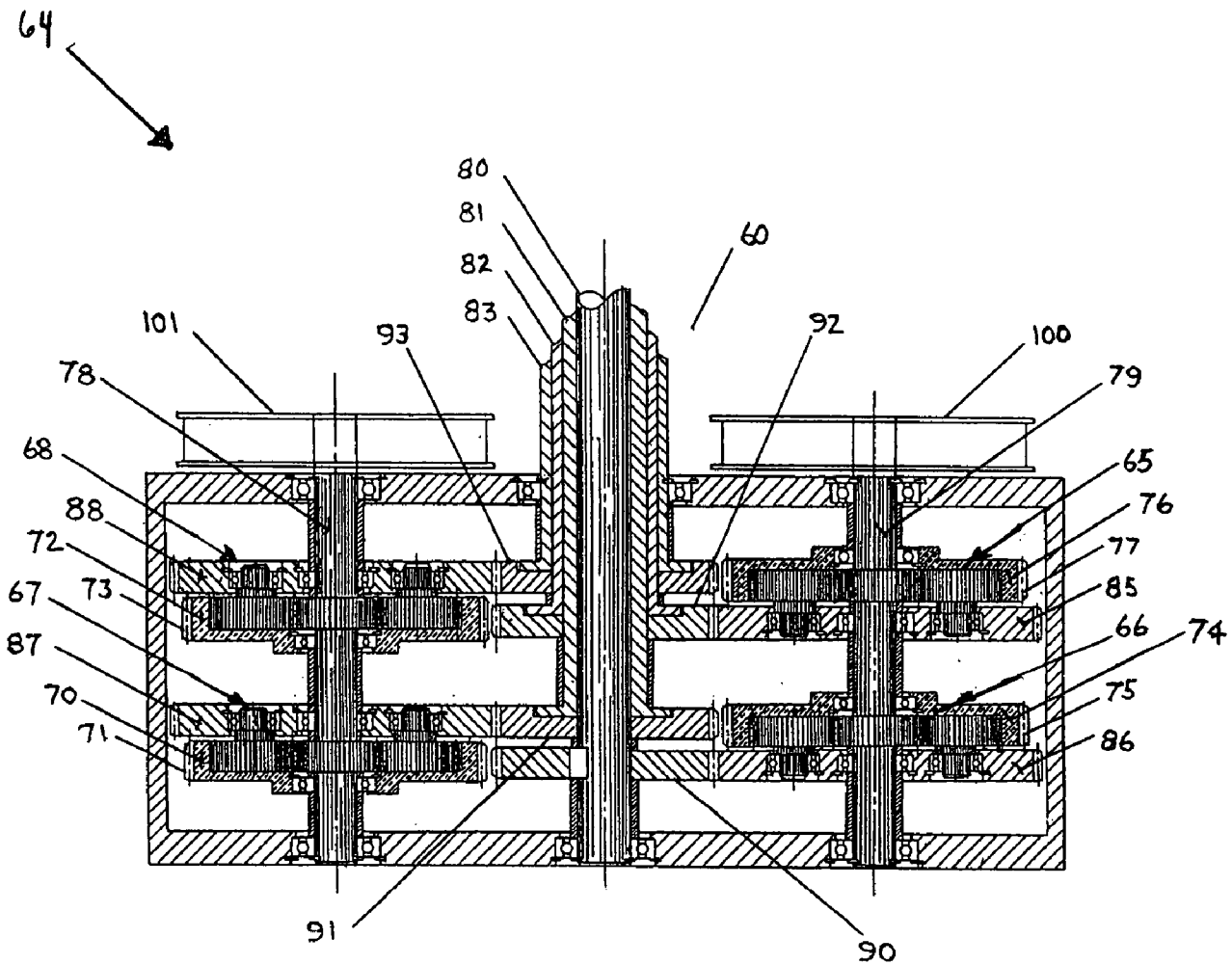
FIGS. 7 and 8A–C are pictorial views of an exemplary mechanical control unit (MCU) of the present invention.

A mechanical control unit (MCU) 64 of one embodiment of the present invention is illustrated in FIG. 7 and includes planetary gearing systems 65, 66, 67, 68. Four concentric shafts 80, 81, 82, 83, each independently controlled by one of planetary gearing systems 66, 67, 65, 68, respectively, together comprises the camshaft for any number of cylinders. In general, MCU 64 will ground and control the internal gears 90, 91, 92, 93 rather than the planetary carriers 86, 87, 85, 88. Rotation of the camshaft at the appropriate speed is available when the internal gear of the planetary gearing systems 66, 67, 65, 68 is grounded and locked and indexing to a desired phase or lag angle is essentially instantaneous by the rotation of the internal gear. Other forms timing variation are possible and the illustration of the planetary gearing systems contained herein is not intended to limit the present invention.

Normal operation of an IC engine adapted with the present invention includes four concentric shafts 80, 81, 82, 83 rotating at the same speed so that there is no relative rotation to each other and each shaft rotates at the appropriate half speed of the crankshaft (not shown). In this condition, all planetary gearing systems are grounded. Indexing of the cams for changing lead and lag phase angles is accomplished by incremental rotations of the external gears 77, 75, 71, 73 of each planetary gearing system 65, 66, 67, 68, respectively. Accordingly, each of the four concentric shafts 80, 81, 82, 83 are independently controlled such that two planetary gearing systems control the lead and lag phase angles of the intake valves and the other two planetary gearing systems control the lead and lag phase angles of the exhaust valves, discussed further below.

Normal operation for constant engine speed with appropriate lead and lag phase angles will proceed with the planetary gearing systems 65, 66, 67, 68 locked by their respective grounded external gears 77, 75, 71, 73. As illustrated, planetary gearing system 67 is locked by external gear 71. In like manner, planetary gearing system 68 is locked by grounded external gear 73, planetary gearing system 66 is locked by external gear 75, and planetary gearing system 65 is locked by grounded external gear 77. With the planetary internal gears 92, 90, 91, 93 locked for all four planetary gearing systems 65, 66, 67, 68, rotation from the crankshaft of the IC engine is transmitted to the MCU 64 through pulleys 100, 101 which, in turn, rotate the input shafts 78, 79 of the planetary gearing systems 65, 66, 67, 68 (FIG. 7). With the planetary internal gears 92, 90, 91, 93 locked the output carriers 85, 86, 87, 88 will all rotate at the same reduced speed such that with its gear meshing with internal gears 90, 91, 92, 93 will rotate concentric shafts 80, 81, 82, 83 at the same speed of one-half the crankshaft speed.

Indexing control of the internal gears 92, 90, 91, 93 to provide lead and lag phase angles is executed by incremental rotation of the heretofore grounded external gears 77, 75, 71, 73 of the planetary gearing systems 65, 66, 67, 68, such that planetary assembly 65, when rotated by its external gear 77, will impart a differential speed to the output concentric shaft 82 through planetary carrier 85 and depending on its rotational sense will advance or retard its rotational position and maintain its position at the original speed with the planetary locked after its transient indexing command. Accordingly planetary gearing system 66 controls the indexing of concentric shaft 80 through its planetary carrier 86; planetary gearing system 67 controls the indexing of concentric shaft 81 through its planetary carrier 87 and planetary gearing system 68 controls the indexing of concentric shaft 83 through its planetary carrier 88. As later illustrated planetary gearing systems 66, 67 are shown as intake valve controls and planetary gearing systems 65, 68 are exhaust valve controls.

Figures 8A, 8B, 8C:
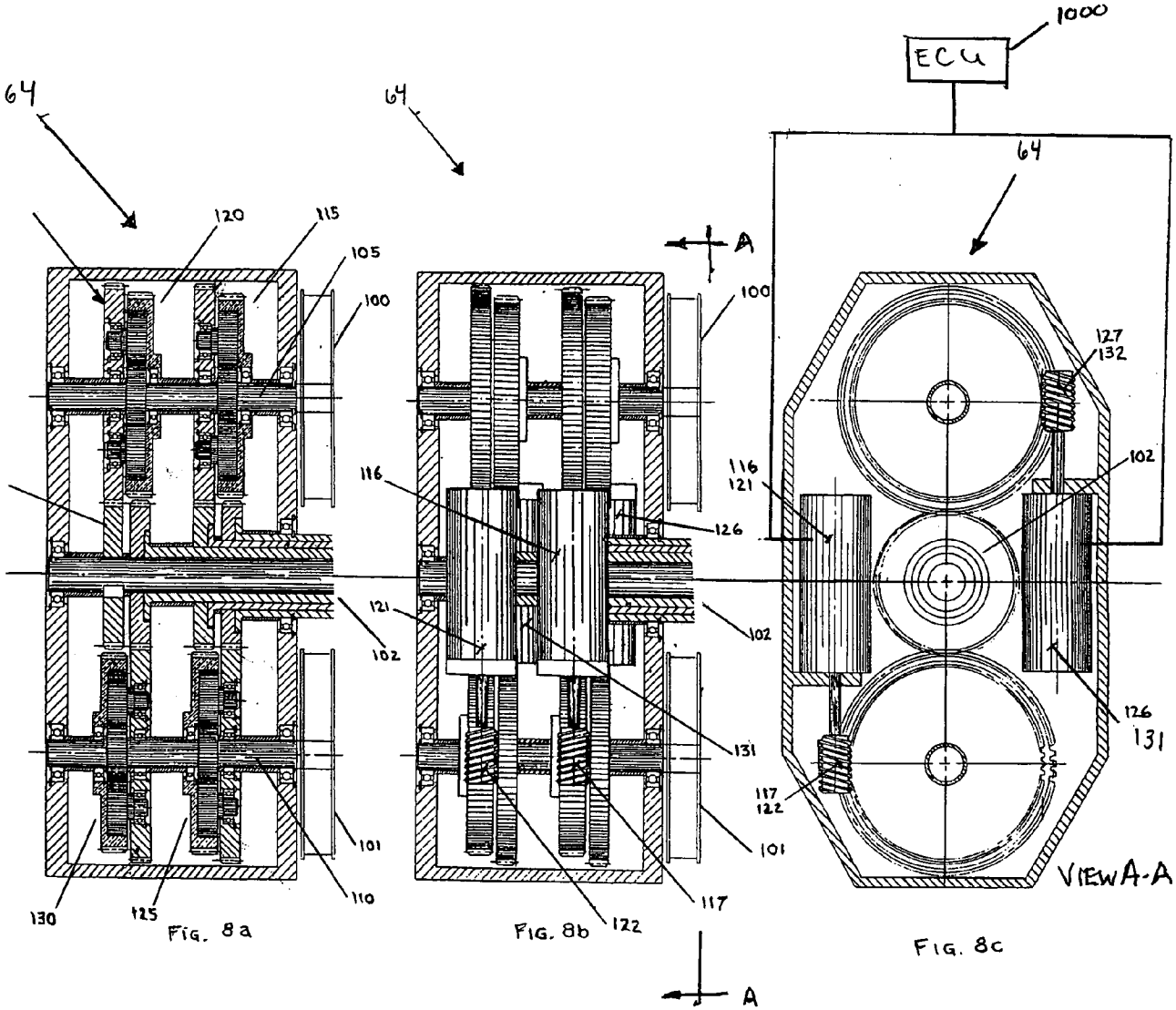

MCU 64, as illustrated in FIGS. 8A, 8B and 8C, receives input from crankshaft (not shown) through two timing pulleys 100, 101, which in turn rotate input shafts 105, 110 (FIG. 8A), which are the input to four planetary gearing systems 115, 120, 125, and 130. The planetary gearing systems are controlled, but not limited to, rotary actuators 116, 121, 126, 131 (FIGS. 8B and 8C); through, but not limited to, worm gear driver units 117, 122, 127, 132 (FIGS. 8B and 8C), which, when stationary, are non-back drivable and ground the planetary gearing system allowing concentric camshaft 102 to rotate at the required on-half speed of the IC engine crankshaft. When a lead or lag phase angle is required for the intake and exhaust valves, commands or signals are transmitted from computerized ECU 1000 to rotary actuators 116, 121, 126, 131 that will incrementally rotate worm gear driver units 117, 122, 127, 132 in rotational sense and angle. The command and transient response will be well within the limits to achieve a smooth and uninterrupted transition to the required phase angles and output speed of the concentric output shaft 102. The above describe system of control is not intended to limit the use of other systems such as hydraulic cylinders or electromechanical linear actuators in conjunction with a rack meshing with a gear on the output planetary carrier.

Figure 9:
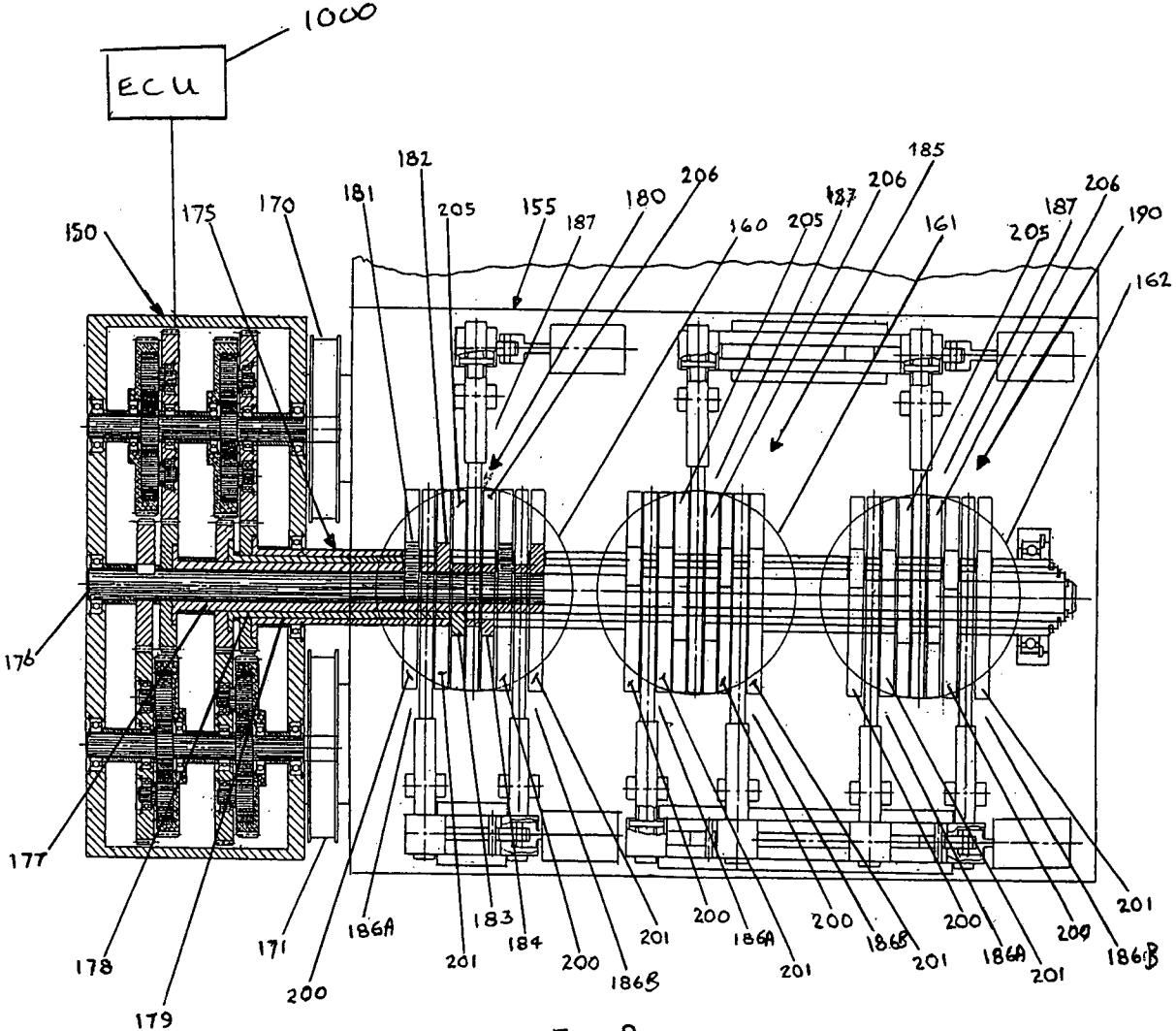
FIGS. 9 and 10 are pictorial views of the MCU of FIG. 7 assembled to the engine block of a six cylinder V6 IC engine with 3 cylinders to illustrate valve control and indexing.

FIG. 9 illustrates MCU 150 assembled to engine block 155 of a six cylinder V6 IC engine with 3 cylinders 160, 161, 162 to demonstrate valve control and indexing. Timing pulleys 170, 171 are driven by crankshaft (not shown) and provide inputs to four concentric camshaft assembly 175. Each cylinder include actuating mechanisms assemblies 180, 185, 190 similar to the 2-valve assemblage described in FIG. 4, which described the phase angle control of an input and exhaust valve arrangement. Valve assemblages 180, 185, 190 are arranged such that two valve assemblages for intake and one valve assemblage for exhaust. The two intake assemblages optimize the intake mixture for homogeneity and the single exhaust valve is oversized to provide an effective aperture for exhaust gas exodus.

Phase angle of the valves is controlled by four concentric shafts 176, 177, 178, 179 rotating to actuate two input valves 186A, 186B and exhaust valve 187 of each cylinder 160, 161, 162. Shafts 176, 177 will control two input valves 186A, 186B through respective keys 181, 182 providing rotation and indexing of respective discs 200, 201 of each cylinder 160, 161, 162. Accordingly, phase angle control of the intake valves in cylinders 160, 161, 162 is achieved simultaneously, precisely and instantaneously for uninterrupted, smooth and desirable engine performance. In like manner, shafts 178, 179 perform the control of single exhaust valves 187 through respective keys 183, 184 providing rotation and indexing of respective discs 205, 206 of each cylinder 160, 161, 162 for phase angle control that is achieved simultaneously, precisely and instantaneously for uninterrupted, smooth and desirable engine performance.

MCU 150 responds to commands from the ECU 1000 producing an infinitely variable valve timing along with variation in the total angular valve opening of the intake valves 186A, 186B. The variable valve lift capability coupled with extended valve open angle capability produces the flexible control of the valves for optimal combustion strategy of a IC engine.

The present invention produces a dwell angle up to 180° without changing the rise and fall cycle. A prolonged dwell angle will allow engine speeds to dramatically increase and thereby improve performance of an IC engine. The present invention produces stoichiometric combustion at substantially all engine speeds that will inspire new transmission designs and result in improved performance and cleaner emissions.

Figure 10A:
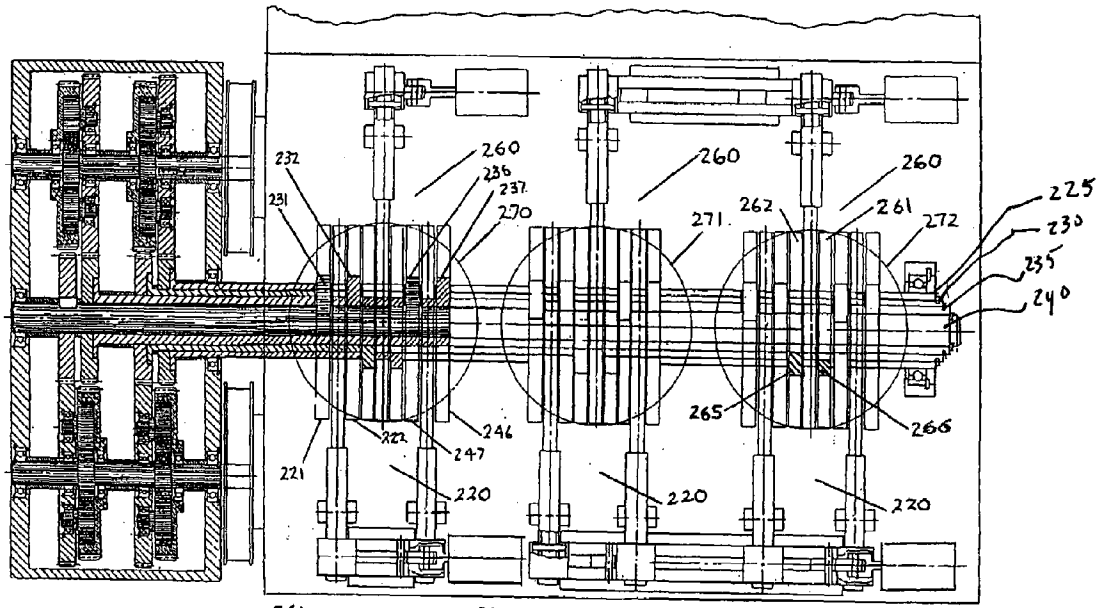
FIG. 10A are pictorial views of the four-concentric shafts of the MCU of FIG. 7 illustrating keyway and slot configuration of each shaft.
Figure 10B:
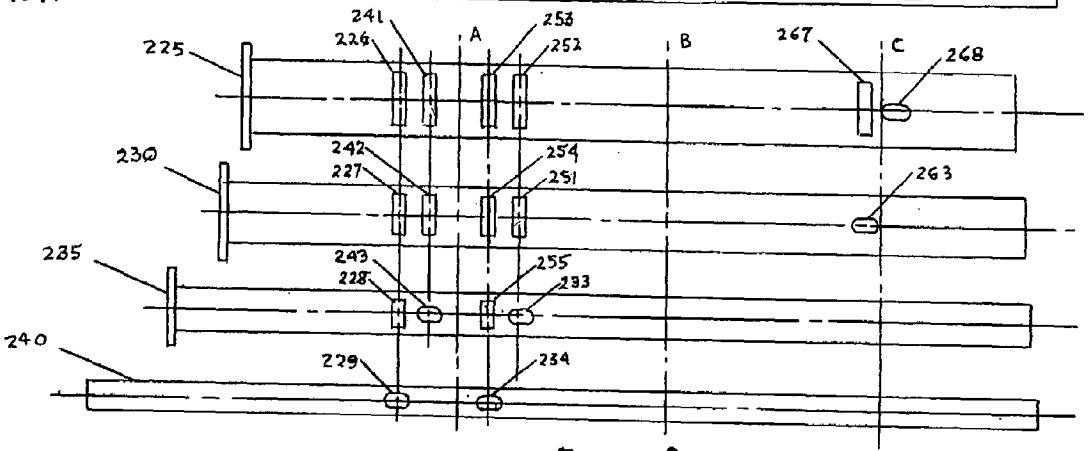

FIGS. 10A and 10B illustrate four concentric shafts 225, 230, 235, 240 having clearance slots and keyways. Intake cam assemblages 220 for the cylinders 270, 271, 272 are controlled by camshafts 235, 240 and drive keys 231, 232. Shaft 240 with keyway 229 and drive key 231 drive disc cam 221 for rotation and indexing. In the process of indexing, clearance for the key is required through its entire range of phase angle variation in shafts 225, 230, 235. Slots 226, 227, 228 of shafts 225, 230, 235, respectively, provide the appropriate clearance. In like manner, shaft 235 with keyway 243 that drives disc cam 222 with drive key 232 has slot clearances 241, 242 in shafts 225, 230, respectively. Intake disc cams 246, 247 are similarly rotated and indexed by concentric shafts 235, 240 through keyways 233, 234, respectively, and drive keys 236, 237 with clearance slots 251, 254 of shaft 230, clearance slots 252, 253 of shaft 225, and clearance slot 255 of shaft 235 similar to clearance slots 226, 241 of shaft 225, clearance slots 227, 242 of shaft 230, clearance slot 228 of shaft 235. Intake clearance slot and keyway juxtapositions are illustrated for the crankshaft angle of the piston in cylinder 270. The identical clearance slot and keyway configurations are substantially required for the concentric shafts for intake valves at the crankshaft angles for cylinders 271, 272. Since the piston crank angle for the piston of cylinder 271 of this example is 120° out of phase with the piston in cylinder 270, it is not possible to show these slots in FIG. 10B. The same is true of the slots for the piston of cylinder 272 that has a crank angle of 240°.

Exhaust assemblage 260 for cylinders 270, 271, 272 is rotated and indexed by shafts 225 and 230 which control cam discs 261 and 262. Keyway 263 with drive key 265 cooperates with clearance slot 267. Keyway 268 with drive key 266 does not require any clearance slots, as it is the outermost concentric shaft.

Accordingly, the configuration of clearance slots and keyways for each cylinder is an overlay of the intake keyways 229, 233, 234, 243 and clearance slots 226, 227, 228, 241, 242, 251, 252, 253, 254, 255 of cylinder 270, and exhaust keyways 263, 268 and clearance slot 267 of cylinder 272 but at the appropriate lead and lag phase angles. This juxtaposition of keyways and clearance slots for cylinder 270 is identical for cylinders 271, and 272 except rotated 120° for cylinder 271 and 240° for cylinder 272 (not shown).

Figures 11, 11A:
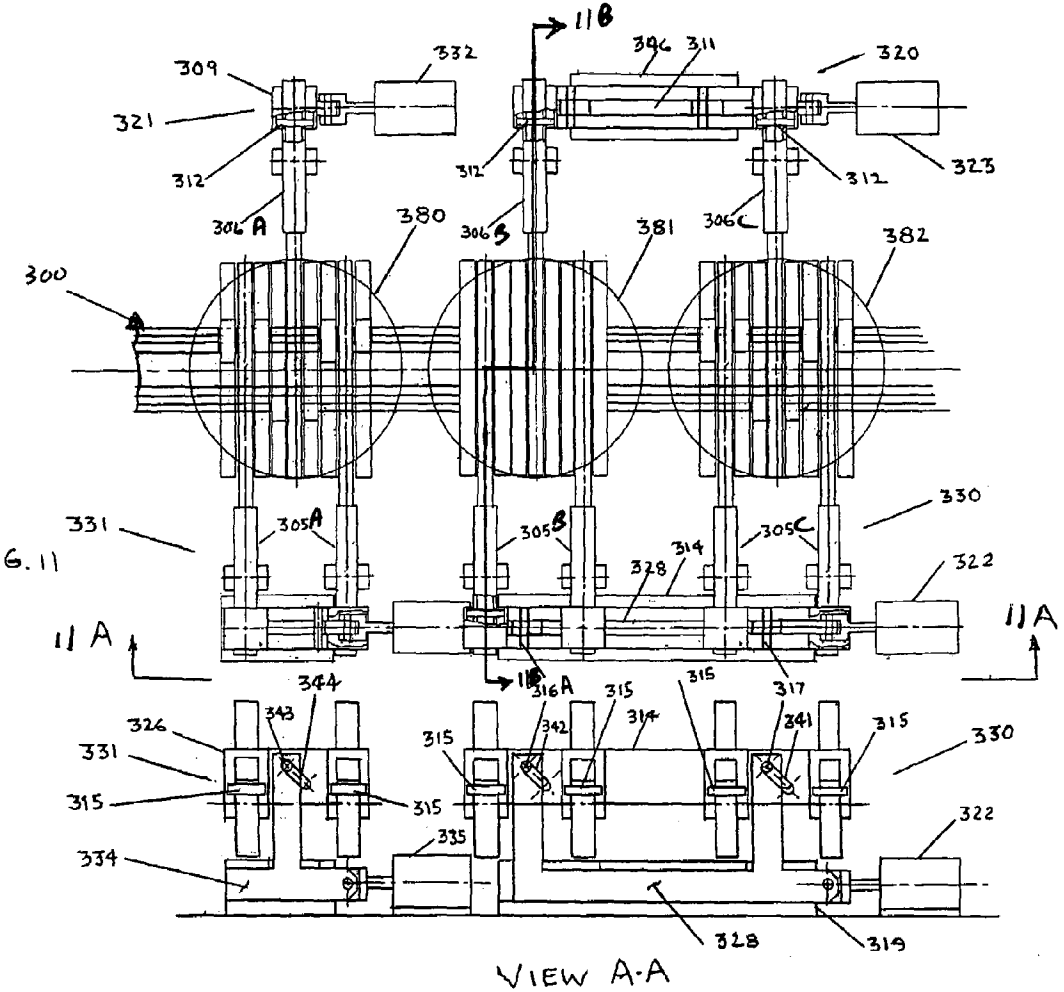
FIGS. 11, 11A, 11B, and 11C are pictorial views of an exemplary assemblages desmodromic valve actuation system of the present invention adapted to and for controlling valve lift of three cylinders of a V6 IC engine.
Figure 11B:
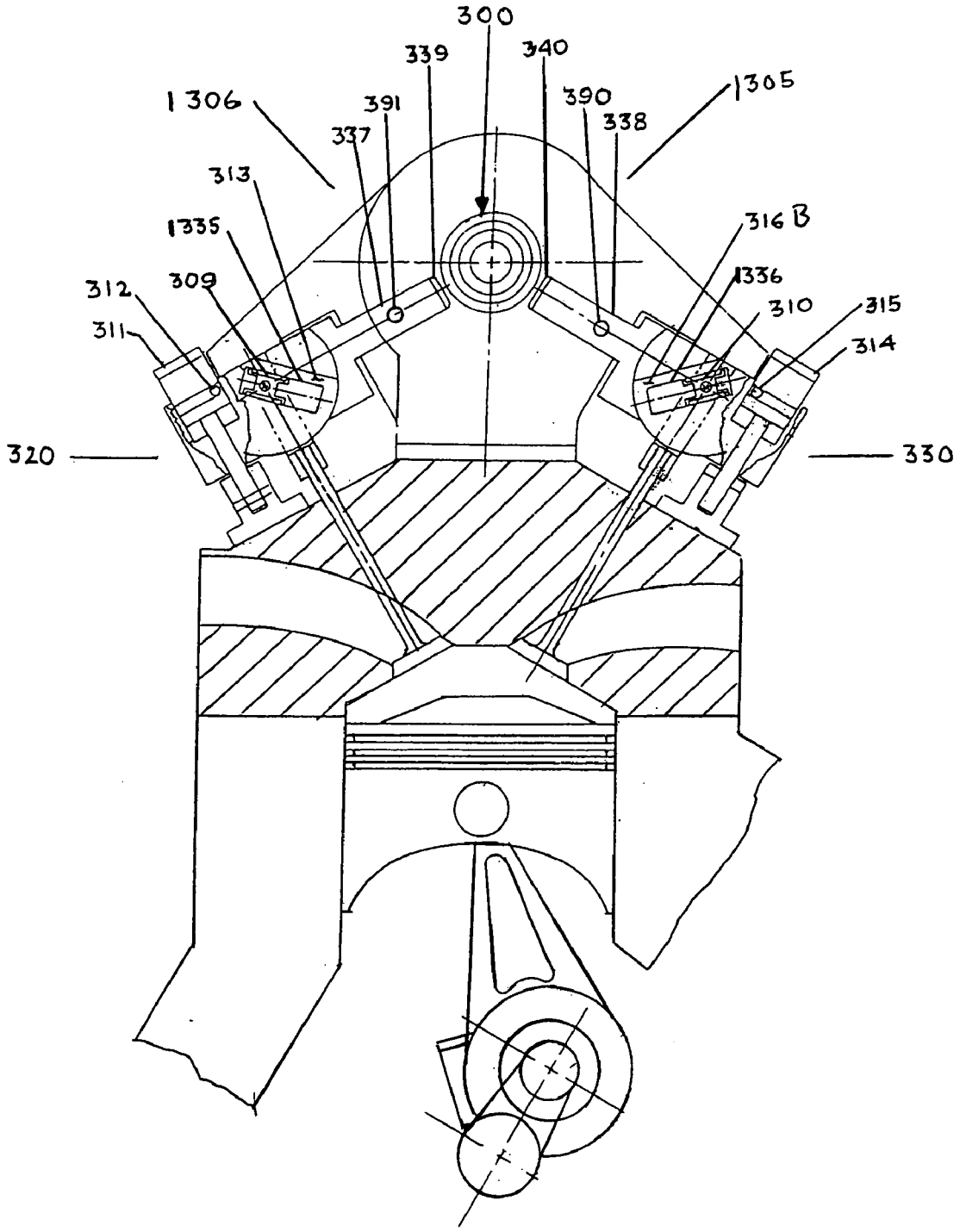

FIGS. 11, 11A, and 11B illustrate one embodiment of the present invention including four concentric shaft design 300 with two complementary discontinuous cams, as previously described, that present a continuous 360° cam track. As previously described, MCU unit controls the angular indexing of the two cams for intake and exhaust valves opening and closing. Indexing, as described above, provides phase angle changes such that control of the overlap between the opening of the intake valve and the closing of the exhaust valve can be between 0° and 90°. A 90° dwell angle at maximum valve opening provides an opportunity to the cylinders to ingest large volumes of air and provide for powerful lean mixtures. Also illustrated is the thermal compensation desmodromic valve actuation system 309 (FIG. 11B) by Folino (U.S. patent application Ser. No. 10/663,965), which is incorporated herein by reference. The present invention is capable of phase angle indexing and valve overlap and zero to maximum valve lift. The control of valve timing by an MCU (described above) can be a control system that is capable of infinite variable valve control from cylinder de-activization to maximum valve lift.

FIGS. 11 and 11A illustrate one embodiment of the present invention having an arrangement of assemblages for controlling valve lift of three cylinders of a V6 IC engine. These valves, two intake valves 305A, 305B and one exhaust valve 306, are shown for each of the three cylinders 380, 381, 382, respectively. Valve lift control assemblages 330, 331 control the intake valves 305A, 305B, and valve lift control assemblages 320, 321 control the exhaust valves 306.

As shown in FIG. 11B, varying the valve lift is accomplished by rotating slotted discs 313, 316 of fixed stator housing assemblies 1305, 1306. Rotation is accomplished by raising and lowering pins 312, 315 of slotted discs 313, 316, thereby rotating slotted discs 313, 316 and changing the angular orientation of respective slots 1335, 1336. As the concentric camshaft rotates the rise and fall cycles of the cam grooves and with its contact with their respective pins 390 and 391, the slides 339 and 338 are displaced in a manner that results in a reciprocation of the slide which causes the vertically restrained valves to move vertically that, in turn, opens and closes the valves. The compensating slide 309 which is acted upon by the angularly positions slot will dictate the amount of lift and opening the valve will achieve. Accordingly, valve lift control assemblages (FIG. 11A) raise and lower pins 312, 315 to control valve lift. A zero angle orientation will result in zero lift and hence cylinder de-activation can be achieved.

One embodiment of the present invention controls intake valves 305A, 305B of cylinders 381, 382 (FIGS. 11 and 11A) by valve lift control assemblage 330 initiated by a command from a computerized ECU (not shown) to hydraulic cylinder 322. Slide 328 is linearly displaced in slide housing 319 by the cylinder and pins 316A, 317, which engage diagonal slots 341, 342, will result in a lift and lowering of control yoke 314 which will turn raise and lower pins 315 of the slotted disc 316B (FIG. 11B). Accordingly, slotted disc 316B will rotate to the predetermined angular rotation for the required lift. Linear measurement of the slide 328 displacement will provide response data to the ECU to complete a closed loop positioning system.

In like manner, it can be seen that the two exhaust valves 306B, 306C of cylinders 381, 382 (FIG. 11A) can be controlled by valve lift assemblage 320 by initiating linear displacement of hydraulic cylinder 323 and translating slide 311 in slide housing 346, which in like manner as described above will ultimately raise and lower pin 312 of the rotating disc 313 FIG. 11B and rotate the slotted disc 313 to its predetermined angular orientation.

Accordingly, two hydraulic cylinders 322, 323 can control the six valves of cylinders 381 and 382. Similarly, the corresponding two cylinders of the opposite bank of three cylinders can be controlled so that four hydraulic cylinders will control the twelve valves of these four cylinders.

Valves of cylinder 380 (FIG. 11A) are controlled by valve lift control assemblage 331 for intake valves 305A and valve lift control assemblage 321 for exhaust valve 306A. Control for intake valves 305A is initiated by hydraulic cylinder 335 that linearly displaces slide 334 and pin 343 in diagonal slot 344 resulting in the raising and lowering of control yoke 314, which raises and lowers pins 315 of slotted disc 316B of stator housing 1305 (FIG. 11B). Accordingly, slotted discs 313, 316 are rotated to the predetermined angular orientation of the diagonal slots 341, 342 to achieve the desired lift and opening of the two valves 305A. The exhaust valve 306A is controlled by valve lift control assemblage 321 and similarly hydraulic cylinder 335 translates slide 334 with pin 343 that engages slot 344 in control yoke 326, which raises and lowers pin 312 (FIG. 11) will rotate the slotted disc 313 (FIG. 11B) to the desired angular orientation of slot 335 to achieve the predetermined valve lift and opening. Similarly, the corresponding cylinders of the other bank are controlled resulting in four hydraulics for the six valves of cylinder 380 and its corresponding cylinder of the opposite bank of three cylinders.

Figure 11C:
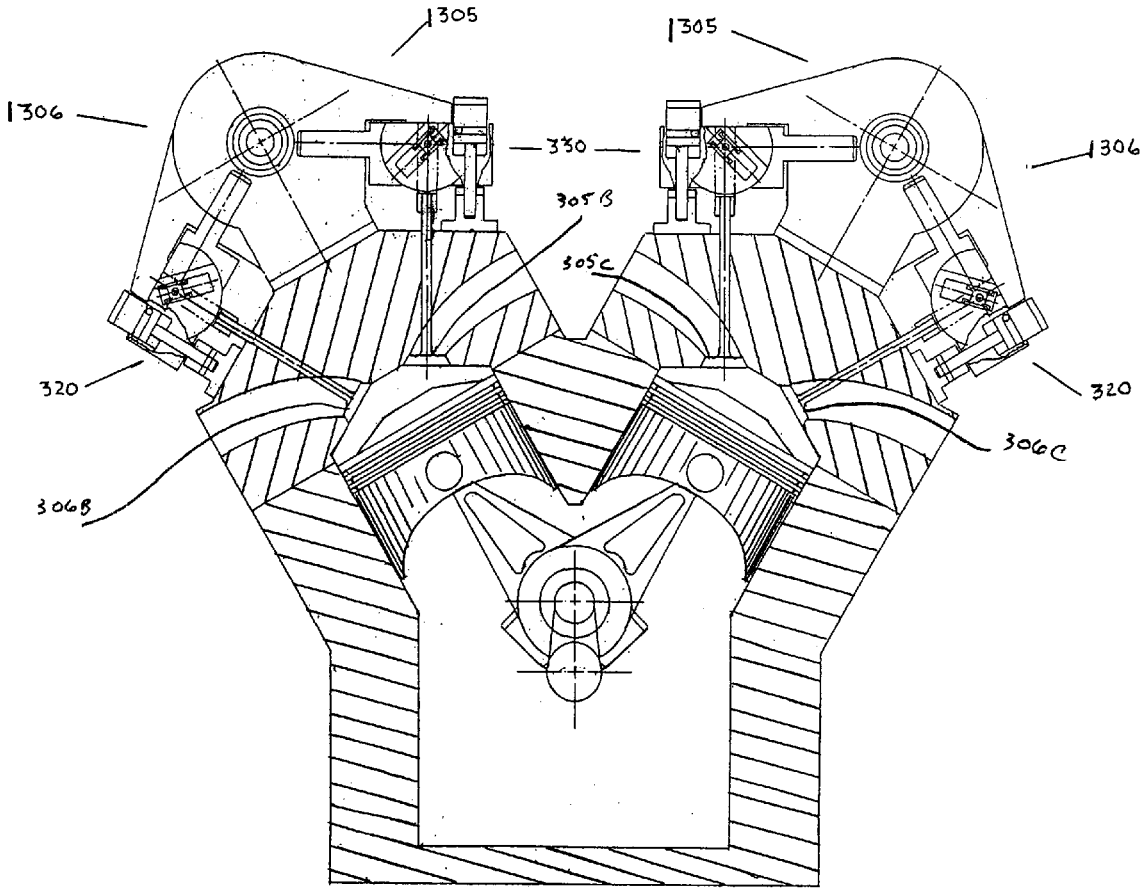

FIG. 11C illustrates an example of valve lift control assemblages of one embodiment of the present invention for two banks of three cylinders of a V6 IC engine. Valve lift control assemblages 1305 are the intake valve lift units and valve lift control assemblages 306 are the exhaust valve units. Valve lift control assemblages 320 are the lift control assemblies of the exhaust valves 306B, 306C, and valve lift control assemblages 330 are the valve lift control units of the intake valves 305B, 305C.

Figure 12:
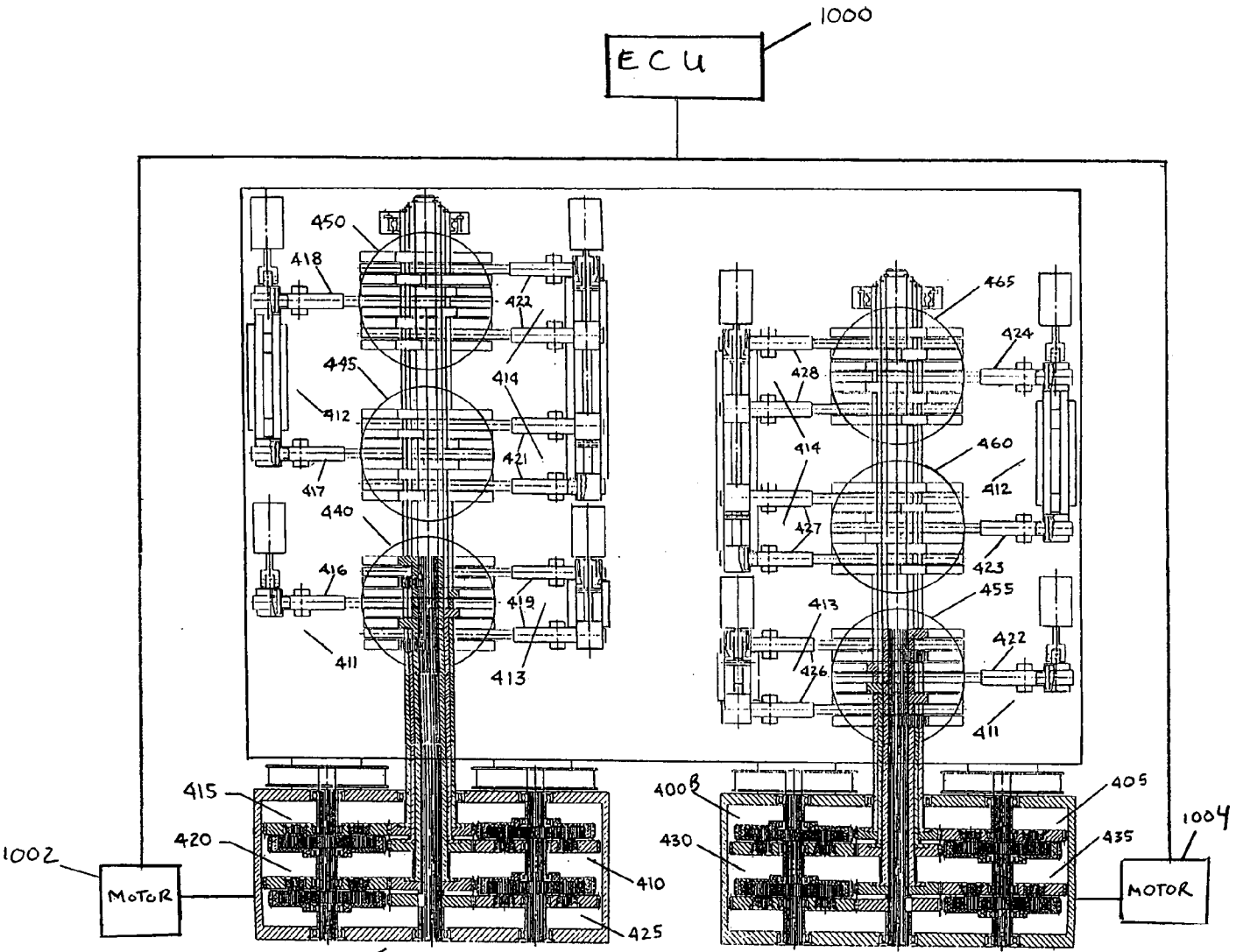
FIG. 12 is a pictorial view of an alternative embodiment of the present invention adapted to a V6 internal combustion engine for controlling phase angle indexing of the valves.

Another example of an alternative embodiment of the present invention is controls for the V6 IC engine with cylinders 440, 445, 450, 455, 460, 465 (FIG. 12). Controls for phase angle indexing of valves are by MCU assemblies 400, 401. Intake valves of cylinders 440, 445, 450 are controlled by planetary gearing systems 410, 415 of MCU 400, and exhaust valves for cylinders 440, 445, 450 are controlled by planetary gearing systems 420, 425 of MCU 400. For cylinders 455, 460, 465, intake valves are controlled by planetary gearing systems 400, 405 of MCU 401, and exhaust valves of cylinders 455, 460, 465 are controlled by planetary gearing systems 430, 435 of MCU 401. Data from computerized conventional ECU 1000 is inputted into the control motors 1002, 1004 in each MCU 400, 401 for intake valves and exhaust valves phase indexing in accordance to engine performance.

Valve lift for the six cylinders is controlled with four control assemblages 411, 412, 413, 414 in each of the two banks of three cylinders. Exhaust valve controllers 416, 417, 418 and intake valve controllers 419, 421, 422 are involved with the variable valve lift of cylinders 440, 445, 450. Exhaust valve controllers 422, 423, 424 and intake valve controllers 426, 427, 428 are involved with the variable valve lift of cylinders 455, 460, 465. Data from the computerized ECU is inputted to hydraulic control valves of each motor to achieve the required valve lift in accordance with engine performance specified by the engine manufacturer.

Accordingly, the ECU commands or conventional signal to the essentially variable features of timing, phase angle control, and valve opening, valve lift, are capable of being synthesized and achieve a full spectrum of combustion strategy relative to power, economy, efficiency and emissions with the apparatus of the present invention. The manufacturing of the system will be economical as very well understood gearing is inexpensive, parts are simple and readily adaptable to mass production and the part count is relatively low.

Operation of the V6 IC engine can be with two, four or six cylinders by simply controlling the valves to near zero lift and de-activating properly selected cylinders. For two-cylinder performance, cylinders 445, 450, 460, 465 are deactivated by zero lift of controllers 412, 414 of the two banks of cylinders. For four-cylinder operation, cylinders 440 and 455 are deactivated by zero lift of the valves by controllers 411 and 413. Operation with six cylinders can require control of all valves of all six cylinders in accordance with engine performance. Deactivization of cylinders in various scenarios of vehicle performance is significantly beneficial in terms of fuel economy and emissions especially for start-ups and city driving. These benefits, along with the benefits of essentially infinitely variable valve timing and lift of the present invention, represent a significant advancement for IC engines in performance, efficiency, economy, drivability and emission control with essentially stoichiometric combustion available at all engine speeds.

The present invention increases the phase angle, the cam track overlap, and the dwell angle. The combination of these improvements provides the opportunity for the valve dwell angle increasing in concert with engine speed. An OEM that does not implement de-activization may not need the variable valve actuator as the air volume requirement can be met with the increased dwell angle at maximum opening.

The valve control system described herein for valve lift and percentage opening were only presented as a means for describing the functional features of the present invention. Other methods and embodiments for valve lift and percentage opening are possible, for example, hydraulic cylinders controlling the valves directly.

The assemblage of FIG. 12 illustrates how two camshafts with four concentric shafts and two control units with four planetary drives can provide continuously variable valve lift and timing in a V6 cylinder of an internal combustion (IC) engine, as described in U.S. Pat. No. 6,619,250, which is incorporated herein by reference. Essentially, all V6 cylinder IC engines require four camshafts, two for each bank of three cylinders. The two camshafts in both banks provide valve control with one controlling the intake valves and the other exhaust valves.

Figure 13B:
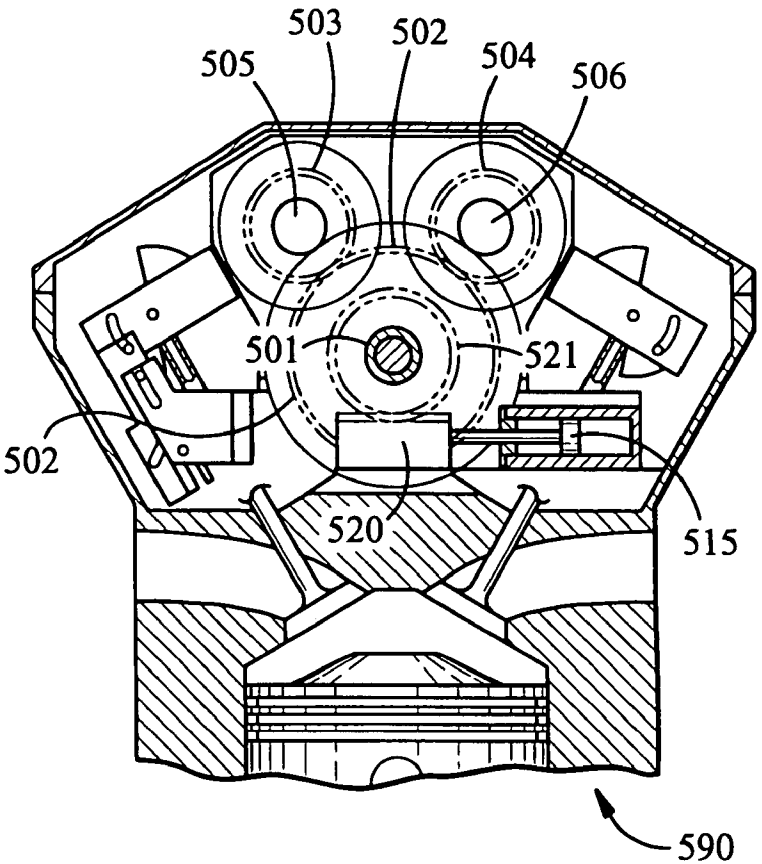
FIGS. 13A and 13B are cross-sectional views of an engine block illustrating an embodiment of the present invention.
Figure 13A:
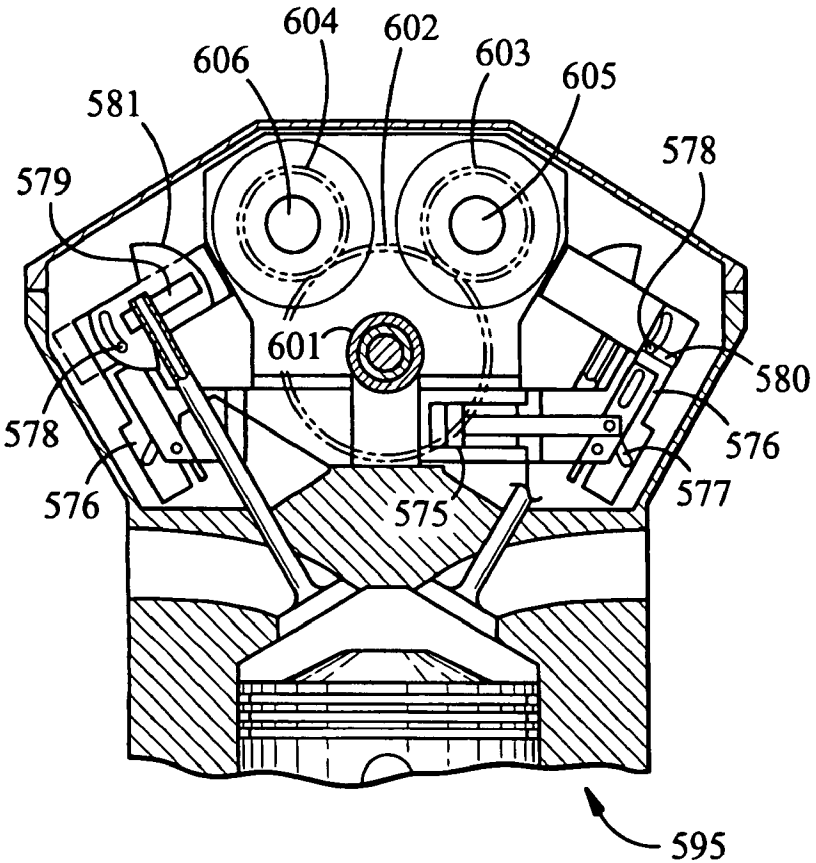

Now turning to FIGS. 13A, 13B, 14A, and 14B, an alternative embodiment of the single camshaft with four concentric shafts may include two camshafts with two concentric shafts (as shown in FIGS. 2A–2D) and imbedded planetary control units. In the alternative embodiment one camshaft controls intake valves and the second camshaft controls exhaust valves. As shown in FIG. 13A and 123B, the engine crankshaft rotates the driveshaft 501 and 601 with gears 502, 602 and, with drive gears 502 and 602, in turn rotate camshafts 505, 506 and 605, 606 through gears 503, 504, and 603, 604, respectively, at the appropriate speed with respect to the planetary speed ratio so that the camshafts are rotating at one half the speed of the crankshaft.

Figure 14A:
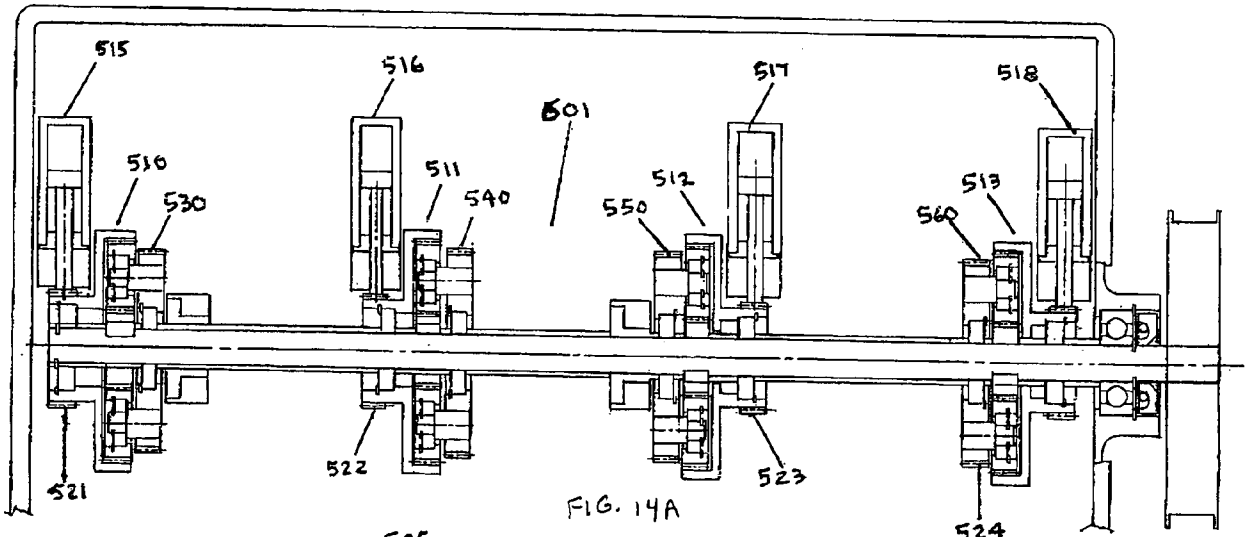
FIGS. 14A and 14B are pictorial views of the embodiment of the present invention of FIGS. 13A and 13B illustrating intake and exhaust valve control mechanism.
Figure 14B:
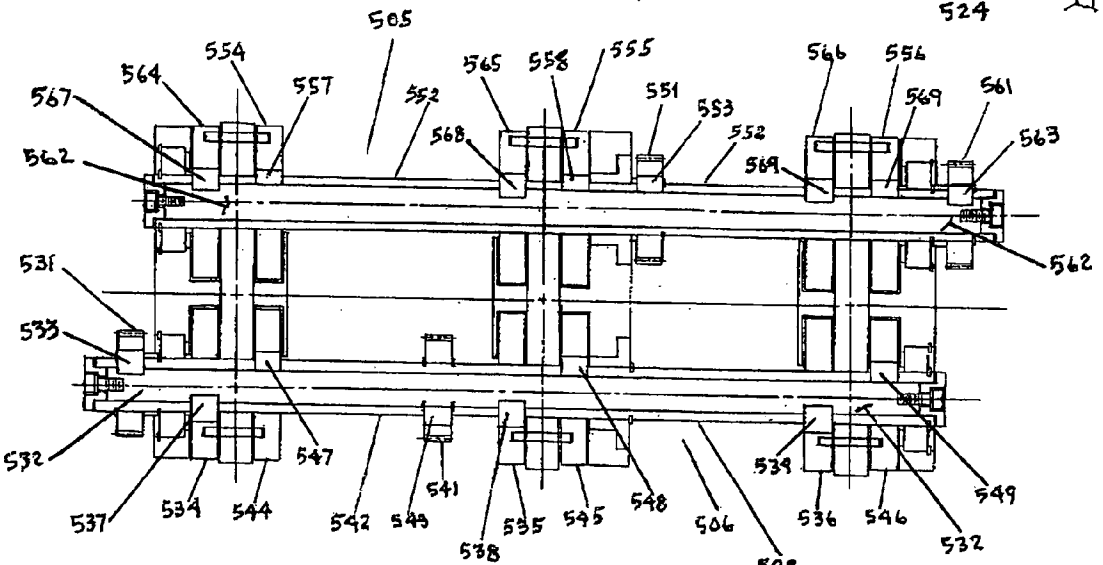

The arrangement of components on both the driveshaft and camshafts are illustrated in FIGS. 14A and 14B. As shown, driveshaft 501 consists of the four planetary control units 510, 511, 512, and 513 with four hydraulic actuator 515, 516, 517 and 518, respectively. A typical hydraulic actuator 515 will drive a gear rack 520 (FIG. 13B) and, in similar fashion as described earlier for the worm drive (FIG. 8). Hydraulic actuator 515 will rotate gear 521 (FIG. 14A) that changes the phase angle relationship and in turn change the timing of the opening or closing of the affected valve. In like manner, hydraulic actuator 516 (FIG. 14A) will displace its respective gear rack and rotate gear 522 and change phase relationship of planetary 511. Hydraulic actuator 517 (FIG. 14A) will control phase relationship of planetary 512. Hydraulic actuator 518 (FIG. 14A) will control phase relationship of planetary 513. All these phase angle changes are independent of each other as the driveshaft rotates and drives each planetary at the same speed.

The phase angle change commanded by the hydraulic actuator 515 through the planetary output gear 530 which meshes with camshaft 531 that is driving the internal shaft 532 of the camshaft 506 through the key 533. Cam disks 534, 535 and 536 are interconnected by keys 537, 538 and 539 to the internal shaft 532. Cam disks 534, 535 and 536 reflect the phase angle change to the discontinuous cams (FIG. 2) within their disk and in turn the timing of its valve. Hydraulic actuator 516 when commanded, through planetary output gear 540 meshed with camshaft gear 541, will drive the outer shaft 542 of the camshaft 506 through key 543. Cam disks 544, 545, and 546 are interconnected by keys 547, 548 and 549 to the outer shaft 542. Cam disks 544, 545, and 546 reflect the phase angle change to their discontinuous cam (FIG. 2) and, in turn, the valve timing. The above sequence of events illustrates how the two cam disks are controlled by the intake camshaft 506 to reflect any given command of phase angle change to bring about the desired timing of the opening and closing, in this case, of the intake valves.

In like manner, it can be shown how the timing of the exhaust valves on camshaft 505 is controlled from the planetary drives on driveshaft 501. Hydraulic actuator 517 (FIG. 14A) through planetary 512 and planetary output gear 550 mesching with camshaft gear 551 will control phase angle change to outer camshaft 552 through key 553. Disks 554, 555 and 556 are interconnected to outer shaft 552 by keys 557, 558 and 559, respectively which, in turn, will change phase angle in accordance to their included discontinuous cam. Accordingly, hydraulic actuator 518 through planetary 513 and planetary output gear 560 meshed with camshaft gear 561 and will control phase angle change to inner camshaft 562 through key 563. Disks 564, 565 and 556 are interconnected to inner camshaft 562 by keys 567, 568 and 569, respectively which, in turn, will change phase angle in accordance with their included discontinuous cam. The synchronizing of each pair of disks 554 and 564, 555 and 565, 556 and 566 will reflect the same phase angle changes and the desired opening and closing of the exhaust valves.

FIG. 13B illustrates planetary control units of the driveshaft 501 modulating intake and exhaust valves for the cylinders in engine block 590, such that continuously variable timing is available for the opening and closing of valves. In similar manner, driveshaft 601 in cylinder block 595 will modulate the intake and exhaust valves of the cylinders in cylinder block 595 through gears 596 on the driveshaft 601, and gears 595 and 597 on the two concentric camshafts 605 and 606 in cylinder block 595.

Figure 15:
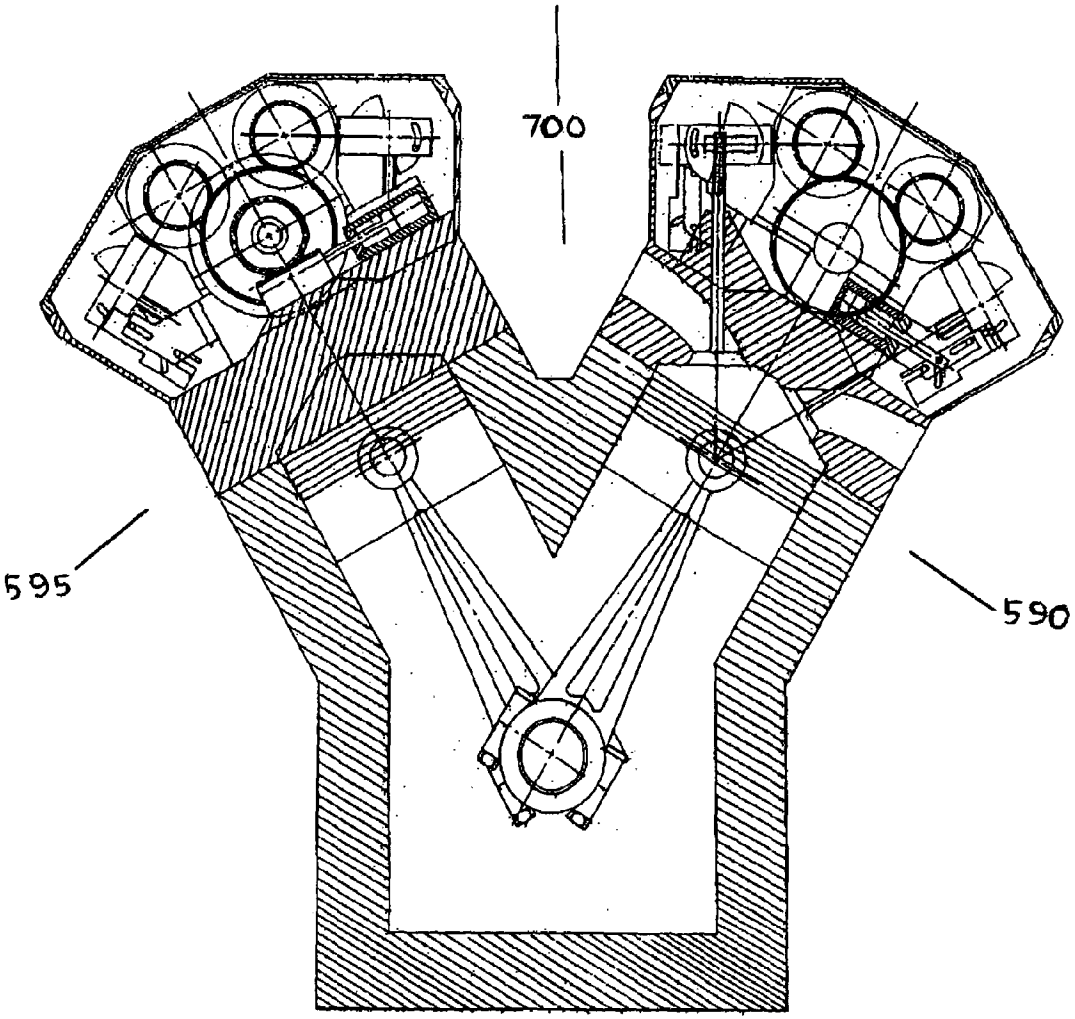
FIG. 15 is a pictorial view of the embodiment of the present invention of FIGS. 13A and 13B adapted to a V6 cylinder internal combustion engine.

FIG. 15 illustrates the overall assembly 700 of a V6 cylinder IC engine utilizing the continuously variable timing and lift capability of all its valves as described above in the present invention for the engine blocks 590 and 595.

Now returning to FIGS. 13A and 13B, hydraulic actuator 575 initiates the method of changing the valve lift as presented in U.S. Pat. No. 6,619,250, and incorporated herein by reference, the methodology of varying the valve lift from zero to maximum lift. Essentially, it involves rotating a slotted disc 579 to a required angle that results in the desired displacement of the valve in and out of the cylinder. As shown, the actuator 575 when stroked will displace the crosshead 576 substantially vertical as a result of the angled slot 577, which is integral with the crosshead. The substantially vertical displacement of the crosshead 576 will displace indexing pin 578 of the rotating disk 581, which will be kept in position in slot 580 during the stroke of the actuator 575 and results in the rotation of the slotted disk 581 to the desired angle or the desired valve travel. The only difference described herein that is in variance with the above referenced patent is the manner in which the slotted disk is rotated. In total, there are twelve actuators, 575, with each actuator controlling two valves for a total of 24 valves. There are variations whereby the number of valves per cylinder could be different or the number of cylinders could be more or less. The described system was presented for the purpose of teaching the basic technology and is not necessarily meant to present a preferred arrangement.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A desmodromic valve actuation system for opening and closing at least one valve of an engine, said system comprising:

a cam assemblage, said cam assemblage including a cam mechanism for rotational movement;

a driving mechanism for reciprocal movement along a first line of action operably connected to said cam mechanism;

said driving mechanism also being operably connected to the at least one valve of the engine to move the at least one valve along a second line of action in a plane substantially non-parallel with said first line of action between a valve closed position and a valve open position and between said open position and said closed position in a manner directly related to said rotational movement of said cam mechanism, wherein said driving mechanism being further capable of maintaining the at least one valve in said closed position while said cam mechanism continues its rotational movement; and the at least one valve being moved between said closed position and said open position and between said open position and said closed position without the intervention of any spring action; and a mechanical control unit operably connected to said cam assemblage, said mechanical control unit indexes said cam assemblage to predetermined rotational phase angles, whereby the rise, fall, and dwell of the at least one valve can be time synchronized and varied.

2. The desmodromic valve actuation system according to claim 1 wherein:

said drive mechanism comprises a slide mechanism having a hole;

said cam mechanism comprises:

a static housing disposed between a pair of opposing cam disks for said rotational movement about a plurality of concentric shafts, said static housing including a slot sized to receive said slide mechanism;

each cam disk of said pair of opposing cam disks include a discontinuous cam track;

said discontinuous cam tracks form a continuous cam track when said discontinuous cam tracks are overlaid;

a cam track follower in movable contact with said discontinuous cam tracks, said cam track follow being capable of responding to either one or both of said discontinuous cam tracks to displace said slide mechanism to motivate the opening and closing of the valves; and said pair of opposing cam disks being operably connected to at least one concentric shaft of said plurality of concentric shafts.

3. The desmodromic valve actuation system according to claim 2 wherein at least one concentric shaft of said plurality of concentric shafts includes a key and a slot of predetermined width.

4. The desmodromic valve mechanism according to claim 2 wherein said mechanical control unit includes a plurality of planetary gearing systems to independently control said plurality of concentric shafts.

5. The desmodromic valve mechanism according to claim 4 wherein said mechanical control unit is responsive to a signal transmitted by an engine control computer.

6. The desmodromic valve mechanism according to claim 5 wherein said mechanical control unit further comprises a motor operably connected to said plurality of planetary gearing systems and in communication with the engine control computer.

* * * * *